US012638278B1

(12) United States Patent
Barnette

(10) Patent No.: US 12,638,278 B1
(45) Date of Patent: May 26, 2026

(54) FIXED BLADE BROADHEAD WITH INTEGRAL FACET SHARPENING GUIDES, INCLUDING INSERTABLE ARROW SHAFT SUPPORT AND CENTRAL INTERIOR CAVITY

(71) Applicant: Darrel Ray Barnette, Austin, TX (US)

(72) Inventor: Darrel Ray Barnette, Austin, TX (US)

( * ) Notice: Subject to any disclaimer, the term of this patent is extended or adjusted under 35 U.S.C. 154(b) by 106 days.

(21) Appl. No.: 18/390,822

(22) Filed: Dec. 20, 2023

Related U.S. Application Data

(60) Provisional application No. 63/538,129, filed on Sep. 13, 2023, provisional application No. 63/438,043, filed on Jan. 10, 2023.

(51) Int. Cl.
*F42B 6/08* (2006.01)

(52) U.S. Cl.
CPC ..... *F42B 6/08* (2013.01)

(58) Field of Classification Search
CPC ..... F42B 6/08
See application file for complete search history.

(56) References Cited

U.S. PATENT DOCUMENTS

| | | | | |
|---|---|---|---|---|
| 2,691,527 | A | 10/1954 | Ramsey | |
| 2,873,973 | A | 2/1959 | Hauch | |
| 4,234,191 | A | 11/1980 | Erlandson | |
| 5,482,294 | A | 1/1996 | Sullivan et al. | |
| 5,496,042 | A | 3/1996 | Craft et al. | |
| 5,636,845 | A | 6/1997 | Newnam | |
| 6,077,179 | A | 6/2000 | Liechty, II | |
| 6,726,581 | B2 | 4/2004 | Muller | |
| 6,921,348 | B1 | 7/2005 | Johnson | |
| 6,939,258 | B2 | 9/2005 | Muller | |
| 7,025,697 | B2 | 4/2006 | Mizek et al. | |
| 7,037,222 | B2 | 5/2006 | Mizek et al. | |
| 7,179,182 | B2 | 2/2007 | Summers | |
| 7,338,397 | B2 | 3/2008 | Mizek et al. | |
| 7,771,297 | B2 | 8/2010 | Kuhn | |
| 8,506,431 | B2 | 8/2013 | Green et al. | |
| 8,771,113 | B2 * | 7/2014 | Patton | F42B 6/08 473/583 |
| 9,366,510 | B1 | 6/2016 | Zobell | |
| 9,658,036 | B2 | 5/2017 | Zobell | |
| 9,739,581 | B2 | 8/2017 | Zobell | |
| 10,054,409 | B2 | 8/2018 | Vanderheyden | |
| 10,866,074 | B1 * | 12/2020 | Morton | F42B 6/08 |
| 11,002,521 | B2 | 5/2021 | Brodie et al. | |
| 11,460,278 | B2 | 10/2022 | Keeney | |
| 12,078,463 | B2 * | 9/2024 | D'Acquisto | F42B 6/08 |
| 12,092,443 | B1 * | 9/2024 | Anderson | F42B 6/08 |
| 2002/0055404 | A1 | 5/2002 | Liechty | |
| 2009/0163308 | A1 | 6/2009 | Odabachian et al. | |
| 2009/0233742 | A1 | 9/2009 | Sanford | |
| 2021/0270584 | A1 * | 9/2021 | Jonsson | F42B 6/08 |
| 2023/0251069 | A1 | 8/2023 | Fisher | |

* cited by examiner

*Primary Examiner* — John A Ricci
(74) *Attorney, Agent, or Firm* — Faegre Drinker Biddle & Reath LLP

(57) ABSTRACT

A fixed blade, two-blade broadhead for use on a hunting arrow that employs multiple, flat surface facets that automatically hold the correct bevel angle for edge sharpening when the broadhead is placed upon a sharpening stone.

21 Claims, 39 Drawing Sheets

FIXED BLADE BROADHEAD WITH INTEGRAL FACET SHARPENING GUIDES, INCLUDING INSERTABLE ARROW SHAFT SUPPORT AND CENTRAL INTERIOR CAVITY

CROSS-REFERENCE TO RELATED APPLICATIONS

The present application claims the benefit of and priority to, under 35 U.S.C. § 119(e), U.S. Provisional Application Ser. No. 63/438,043, filed Jan. 10, 2023, entitled FIXED BLADE BROADHEAD WITH INTEGRAL FACE-FACET SHARPENING GUIDES, and U.S. Provisional Application Ser. No. 63/538,129, filed Sep. 13, 2023, entitled FIXED BLADE BROADHEAD WITH INTEGRAL FACE-FACET SHARPENING GUIDES, INCLUDING INSERTABLE ARROW SHAFT SUPPORT AND CENTRAL INTERIOR CAVITY, which are hereby incorporated by reference in their entireties for all purposes.

BACKGROUND

It is desirable for metal, fixed blade, two-blade monolithic broadheads to include a sharp cutting edge to kill humanely. As with sharpening any bladed-edge tool, manually holding the correct edge-bevel angle consistently against a sharpening stone is difficult and usually requires additional blade-guide hardware in order to maintain the bevel angle while sharpening. Blade sharpening is a learned skill that requires practice in order to be proficient, and many bow hunters lack this proficiency. Manufacturers of broadheads circumvent this process in many instances by offering replaceable blade broadheads; however, these broadheads are not as structurally sound as one-piece fixed blade broadheads.

In addition, current state of the art arrow shafts typically consist of hollow tubing made from carbon fiber and/or aluminum. Two principle means by which a broadhead is attached to the arrow shaft include either (1) a separate internally threaded metal insert which is inserted into and glued to one end of the arrow shaft and receives an externally threaded integral stem at the rear of the broadhead, or, (2) a separate tubular outsert which internally receives the glued-on arrow shaft at the proximal end of the outsert and threadably receives the externally threaded stem of the broadhead on the distal end of the outsert. The primary disadvantage of the insert system is that under hard impact the insert can set back into and damage the arrow shaft causing loss of structural integrity of the arrow. The primary disadvantage of the outsert system is that attachment of the broadhead is external to and separated from the end of the arrow shaft, which may negatively affect the concentricity of the assembled arrow due manufacturing tolerance stack-up. Also, the outsert may permanently deform when subject to impact forces, which also negatively affects concentricity. In addition, if the outsert or the insert attachment system is placed under lateral (i.e., non-axial) loading the arrow shaft may permanently deform or break just aft of either the insert or the outsert where the lateral bending stiffness of the arrow shaft is abruptly reduced. Such lateral loading may occur for instance when the arrow impacts a hard surface at an oblique angle.

Furthermore, arrow tuning for best flight and penetration performance often involves varying the point weight (front-end weight) of the arrow to dynamically tune the arrow to the bow. Changing the weight of the front end of the arrow is generally achieved by de-bonding the glue joint of an installed insert or outsert and exchanging it for one of a heavy or lighter weight, and/or by removing and exchanging the broadhead itself for one of either heavier or lighter weight. This procedure can be time consuming and expensive as the individual components (the broadhead and the insert or the outsert) each may need to be replaced in order to achieve the desired performance. Unfortunately, current broadhead designs are generally manufactured in standard weights, and the weight of the broadhead required for optimal tuning may not be available.

It is common knowledge in the archery community that fixed blade broadheads do not fly the same as either mechanical broadheads (i.e., broadheads whose blades are partially or fully retracted and hidden from the airflow during flight but extend during the impact event), or field points. The main issue is that the field points and the nose tips of mechanical broadheads are more streamlined than fixed blade broadheads and therefore have less aerodynamic lift and drag forces associated with them. While this in itself is desirable, in some instances streamlining may adversely affect penetration performance as the penetration channel created by the streamlined tip may be small in diameter and thus insufficiently lethal.

What is needed is an improvement over the foregoing.

SUMMARY

Some embodiments of the present disclosure relate to a fixed blade, two-blade broadhead for use on a hunting arrow that employs multiple, flat surface facets that automatically hold the correct bevel angle for edge sharpening when the broadhead is placed upon a sharpening stone. As the facets are each in turn laid flat and stroked against the sharpening stone, the cutting edges of the broadhead are sharpened without the need of additional sharpening guides or a high degree of skill. The broadhead may initially be coated with an oxide layer, bluing, etc., such that when the coating is removed during the sharpening process, the whole of each individual flat surface facet is cleanly exposed thereby indicating that the cutting edges have been sharpened. Identification markings in the form of debossed lettering or sub-surface annotations engraved into the facet(s) will protect the sub-surface coating in this area during the sharpening process, such that the identification markings will remain coated and highly visible after sharpening is completed. Additionally, the flat surface facets may be oriented such that axial rotation of the broadhead is induced during the penetration event, aiding in splitting bone and reducing resistance to penetration, further enhancing lethality. The concept allows for broadhead weight reduction via material removal within the facet(s) without changing the planform shape of the broadhead and without detracting from the functionality of the facets as an aid in sharpening the edges of the broadhead.

Broadheads according to some embodiments of the present disclosure may be larger in all radial directions, from the central axis, than the outside diameter of the arrow shaft. This is advantageous as it creates a penetration channel diameter that is larger than the arrow shaft diameter. Further taking advantage of this feature, in another embodiment it is possible to eliminate the externally threaded integral stem of the broadhead and instead bore out a circular cavity into the rear of the broadhead such that the end of the arrow shaft may be fully received within the body of the broadhead. In essence the broadhead then becomes an integral outsert and eliminates the need for a separate outsert to connect the broadhead to the arrow shaft. In this case the broadhead embodiment is held fixed to the arrow shaft by means of a separate stem that is directly glued into the arrow shaft with an integral externally threaded portion that extends past the end of the arrow shaft and mates with internal threads present in the circular cavity interior to the broadhead. If the separate insert or outsert is to be retained, the separate stem may also be offered in an externally threaded configuration to be received by internal threading present on the separate outsert or insert. Further extending this concept, in another embodiment the arrow shaft and the external threads of the glued-in stem may be internally received by a radially split, externally tapered collet itself having an integral externally threaded portion extending past the end of the received arrow shaft. The collet is received via both internal threads and a matching tapered section in the circular cavity interior to the broadhead. Upon assembly the tapered collet is threadably drawn into the matching tapered section interior to the broadhead, forcing the split collet to tightly close around the arrow shaft. The collet serves to align the arrow shaft with the central axis of the broadhead, to hold the arrow shaft fixed to the broadhead, and to automatically adapt the broadhead to differing arrow shaft outside diameters offered by various manufacturers. In this embodiment, multiple redundancy in attachment of the arrow shaft to the broadhead is achieved through chemical engagement via glue, mechanical engagement via threads, and pressure engagement from the collet.

Furthermore, the bored-out cavity of the broadhead may extend forward for some distance without breaking through the side walls of the broadhead. The cavity thus created may be partially or fully filled with a high density core to increase the weight of the broadhead. This cavity may be present independent of the ability of the broadhead to internally receive the arrow shaft. If the arrow shaft is not received by the cavity, a separate externally threaded stem may be used to join the broadhead to the arrow shaft.

Some embodiments of the present disclosure relate to field points and to separable nosetips of mechanical broadheads that include multiple, flat facets that automatically maintain a proper bevel angle during sharpening. Such field points and mechanical broadheads may match the flight performance of a two blade broadhead employing the same features, but may also enhance the penetration performance of the field points when pursuing small game, or the penetration performance through bone when these features are incorporated into a nosetip of a mechanical broadhead.

BRIEF DESCRIPTION OF THE DRAWINGS

The above mentioned and other features of the disclosure, and the manner of attaining them, will become more apparent and the disclosure itself will be better understood by reference to the following description of embodiments of the disclosure taken in conjunction with the accompanying drawings.

The exemplifications set out herein illustrates an embodiment of the disclosure, and such exemplifications are not to be construed as limiting the scope of the disclosure in any manner.

DETAILED DESCRIPTION

Figure 1:
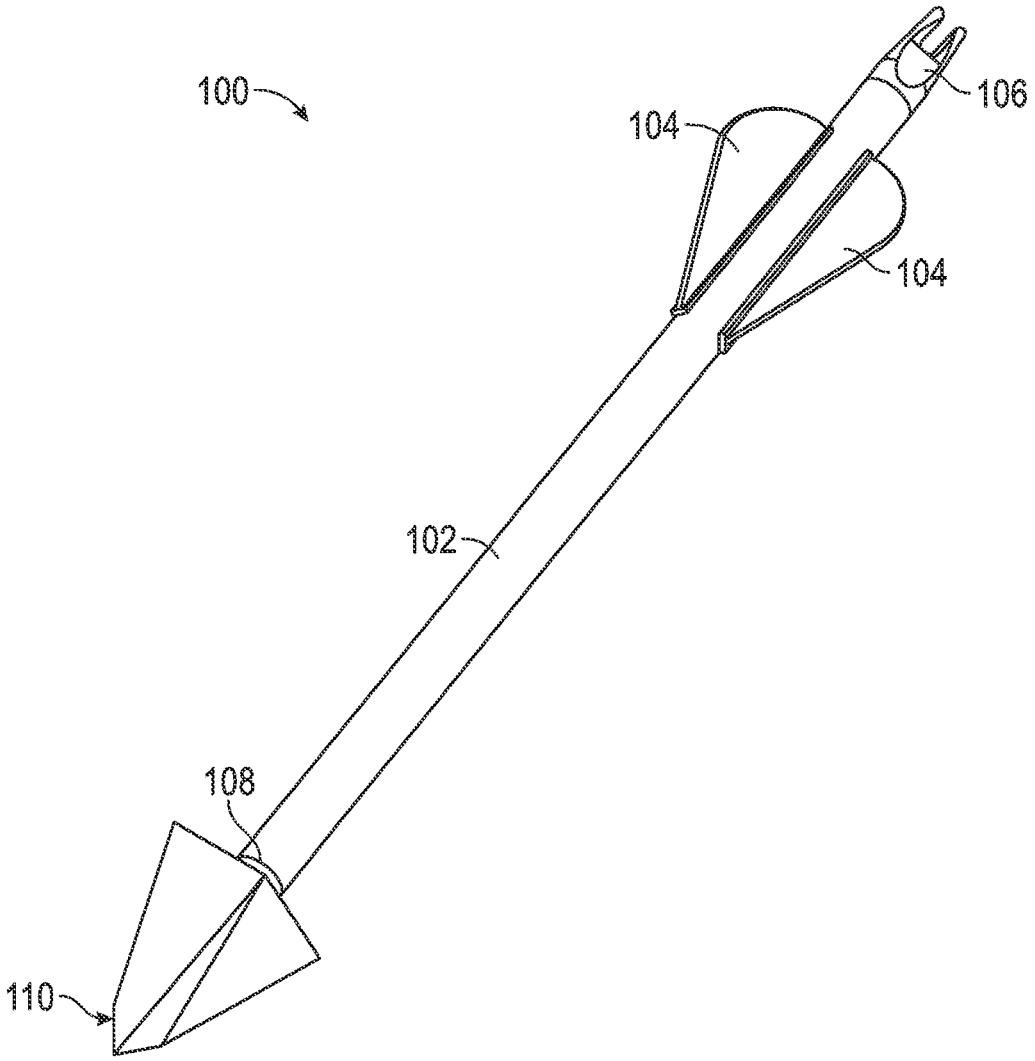
FIG. 1 is a perspective view of an arrow system including a broadhead, an insert, an arrow shaft, a fletching, and a string nock according to an embodiment of the present disclosure.
Figure 2:
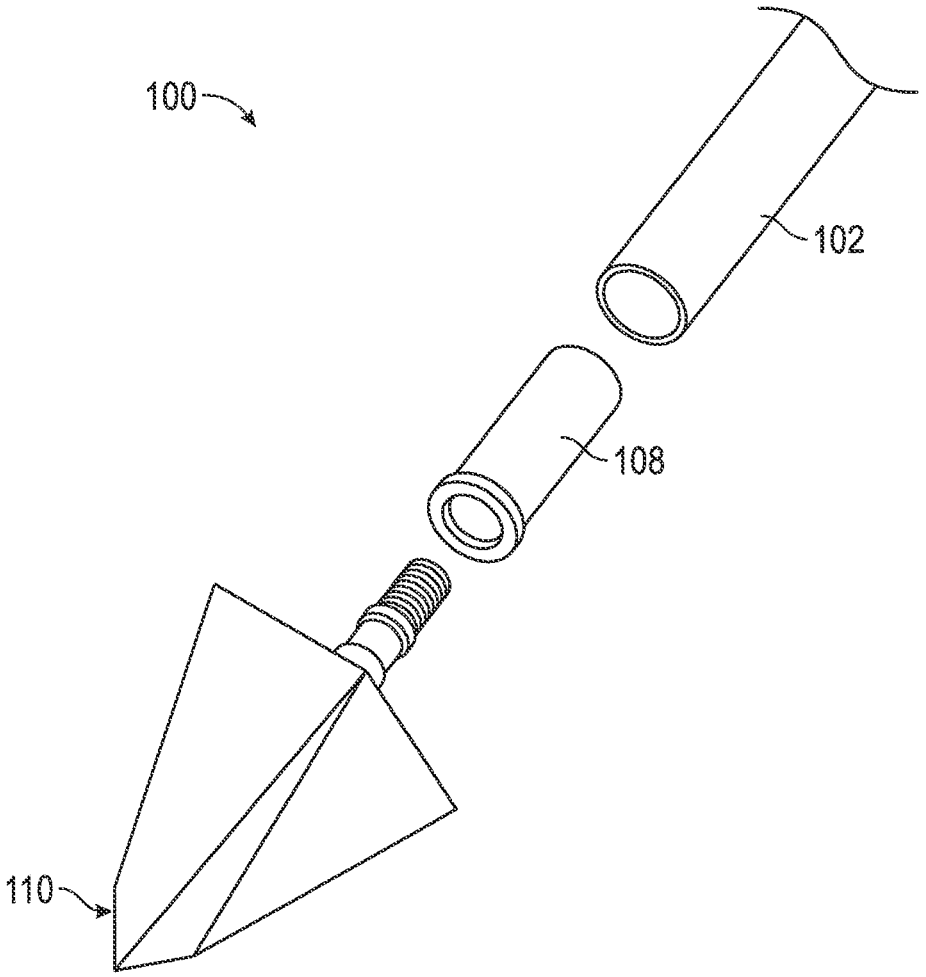
FIG. 2 is an enlarged exploded perspective view of the arrow system of FIG. 1.
Figure 3:
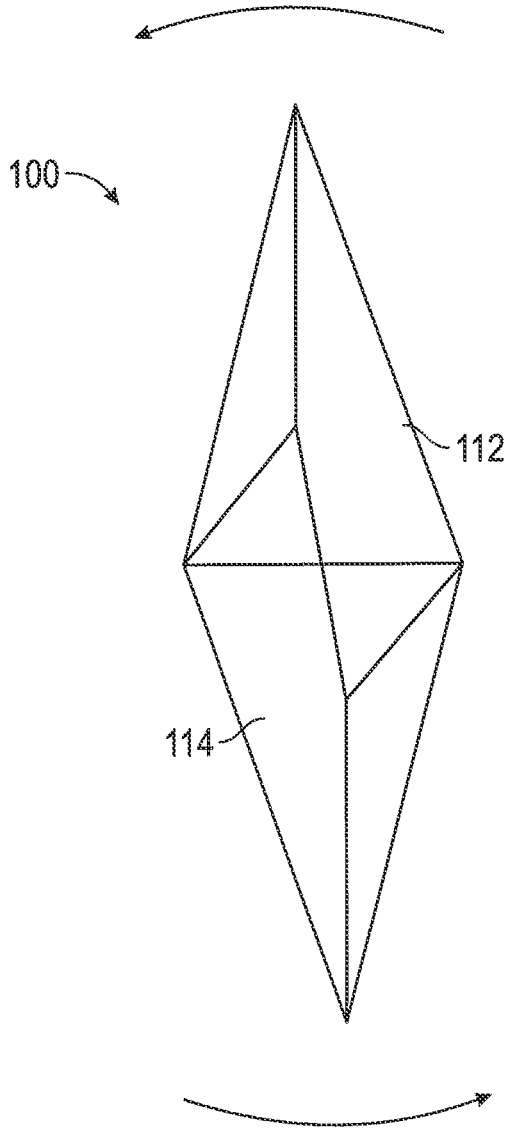
FIG. 3 is a front view of the broadhead of FIG. 1.
Figure 4:
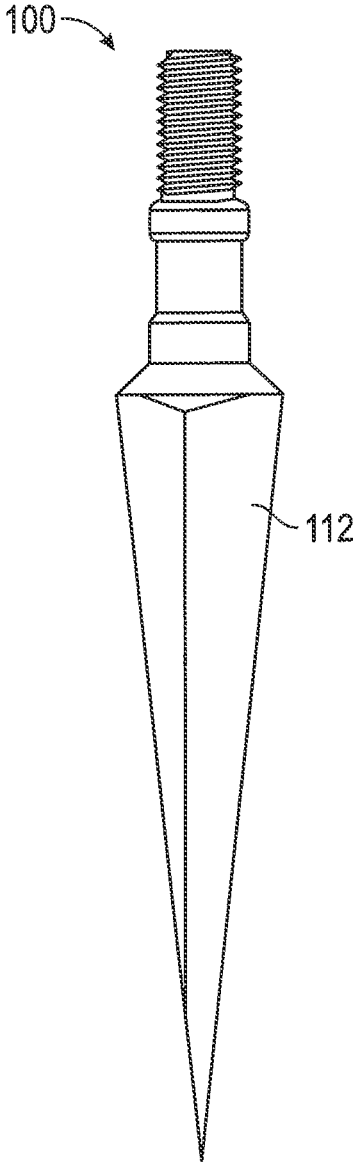
FIG. 4 is a top view of the broadhead of FIG. 1.
Figure 5:
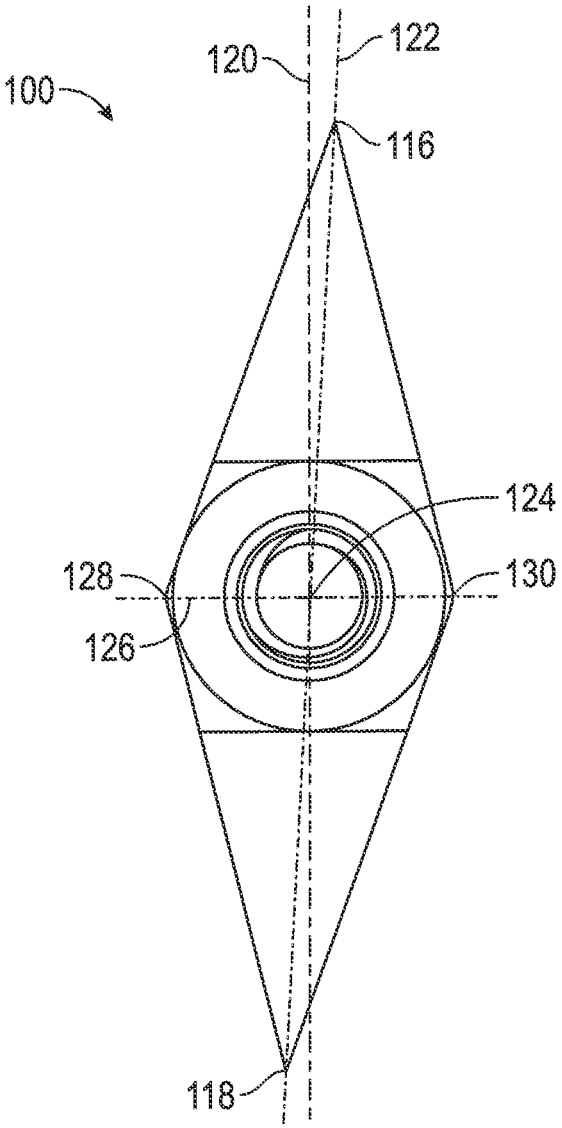
FIG. 5 is a rear view the broadhead of FIG. 1.
Figure 6:
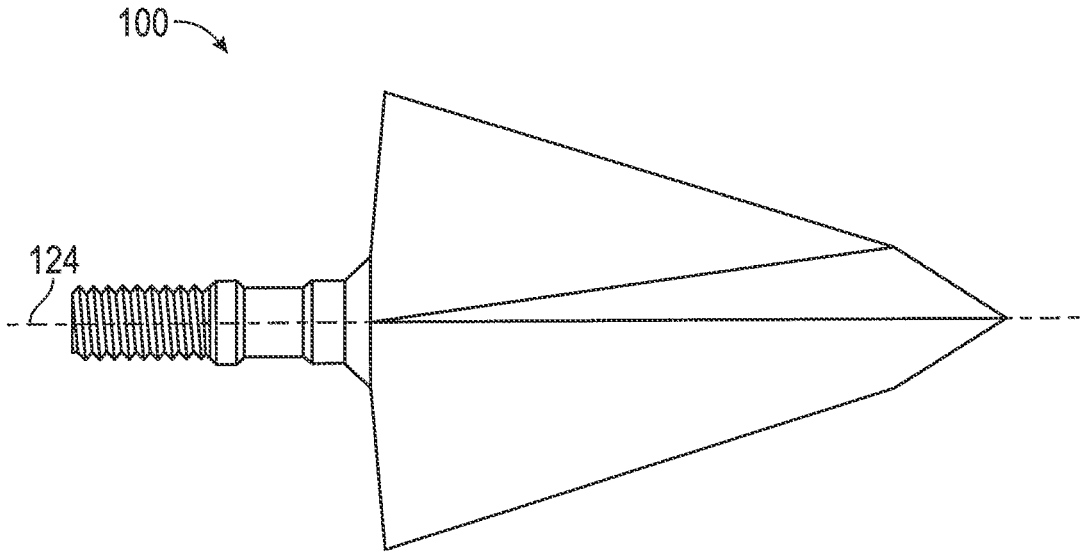
FIG. 6 is a right side view the broadhead of FIG. 1.
Figure 7:
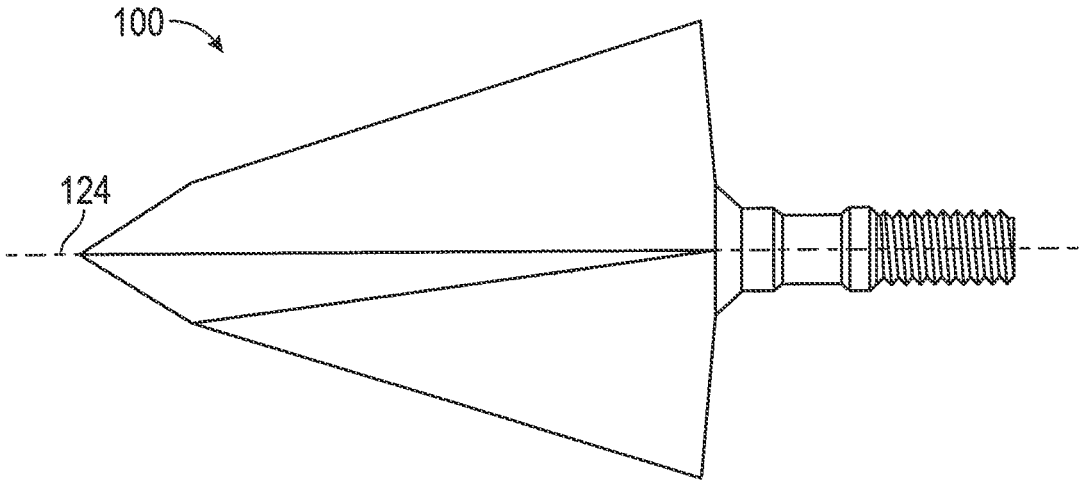
FIG. 7 is a left side view the broadhead of FIG. 1.

FIGS. 1-7 show an arrow system 100, or components thereof, according to an embodiment of the present disclosure. FIG. 1 shows a perspective view of arrow system 100, which includes an arrow shaft 102, a fletching 104, a string nock 106, and an insert 108 which threadably receives a broadhead 110. Arrow shaft 102, fletching 104, string nock 106, and insert 108 may take any conventional form known to those of ordinary skill in the art. FIG. 2 shows an enlarged exploded view of arrow system 100. Insert 108 may be glued into arrow shaft 102, and broadhead 110 may be threadably attached to insert 108 and, as a result, is easily removed for sharpening or for replacement. FIG. 3 shows a front view of broadhead 110 in which all 180 degree axially rotationally symmetric facets are visible. A large primary facet 112 is positioned toward the upper right of the view and a large primary facet 114 is positioned toward the lower left of the view. Primary facets 112, 114 present the most surface area as viewed in FIG. 3 compared to all other facets, and as a result combine to produce a relative counterclockwise rotation during penetration as indicated by the arrows due the greater force exerted on these particular facets by the target. FIG. 4 also shows the relative large size of primary facet 112. Primary facets 112, 114 are an advantageous feature of broadhead 110 and, as shown in FIG. 5, are produced by rotationally offsetting opposing cutting edges 116, 118 relative to a vertical midplane 120. Stated another way, broadhead 110 includes an elongated midplane 122 in which the central or longitudinal axis 124 lies, and elongated midplane 122 intersects with first and second cutting edges 116, 118 of broadhead 110. Elongated midplane 122 is rotationally offset from vertical midplane 120 of broadhead 110, which is perpendicular to a horizontal midplane 126 of broadhead 110. Longitudinal axis 124 lies in both vertical midplane 120 and horizontal midplane 126 of broadhead 110. Horizontal midplane 126 also intersects with opposite edges 128, 130 across the narrow dimension of broadhead 110. The side profile of broadhead 110 is shown in FIG. 6 (right side view) and FIG. 7 (left side view), and these views illustrate the rotationally-symmetric layout of the facets about central axis 124 of broadhead 110.

Figure 8:
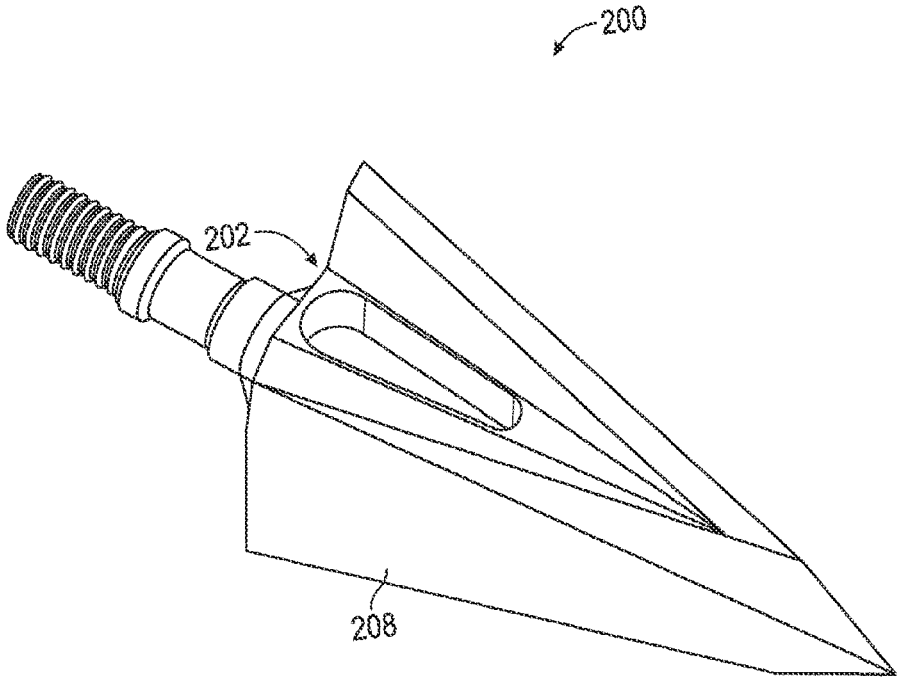
FIG. 8 is a right side perspective view of a broadhead according to another embodiment of the present disclosure.
Figure 9:
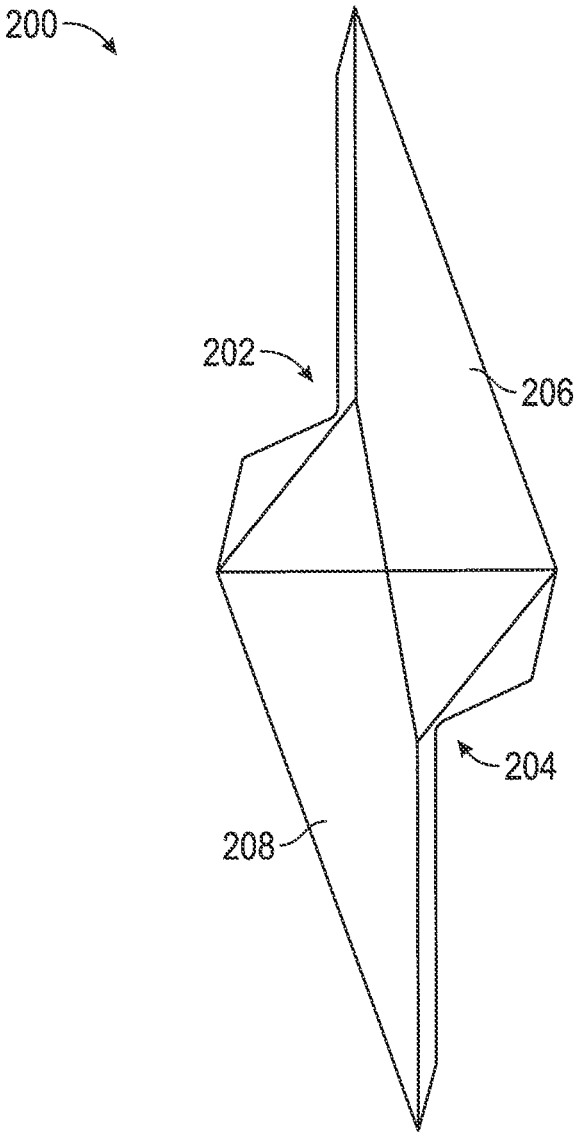
FIG. 9 is a front view of the broadhead of FIG. 8.
Figure 10:
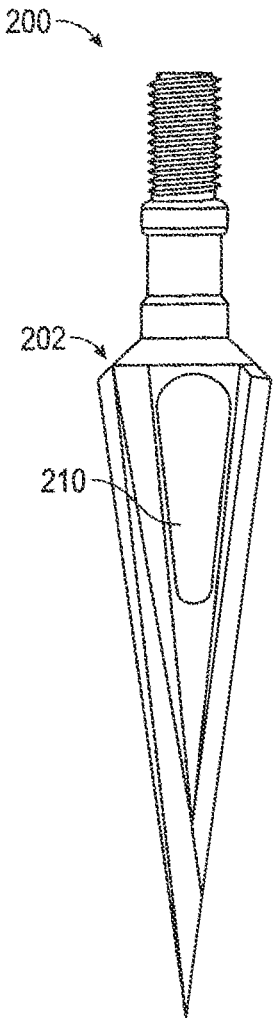
FIG. 10 is a top view of the broadhead of FIG. 8.
Figure 11:
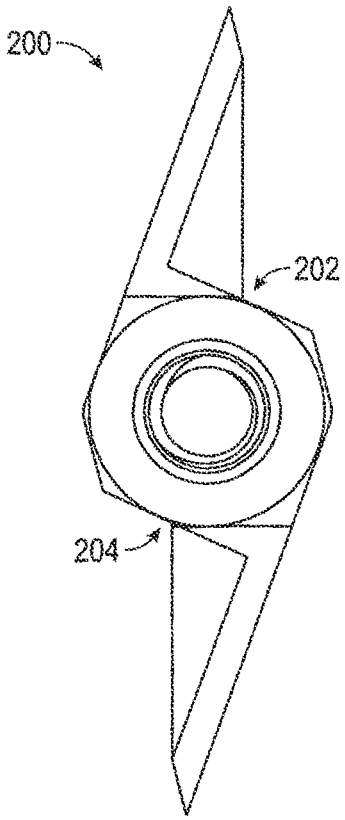
FIG. 11 is a rear view of the broadhead of FIG. 8.
Figure 12:
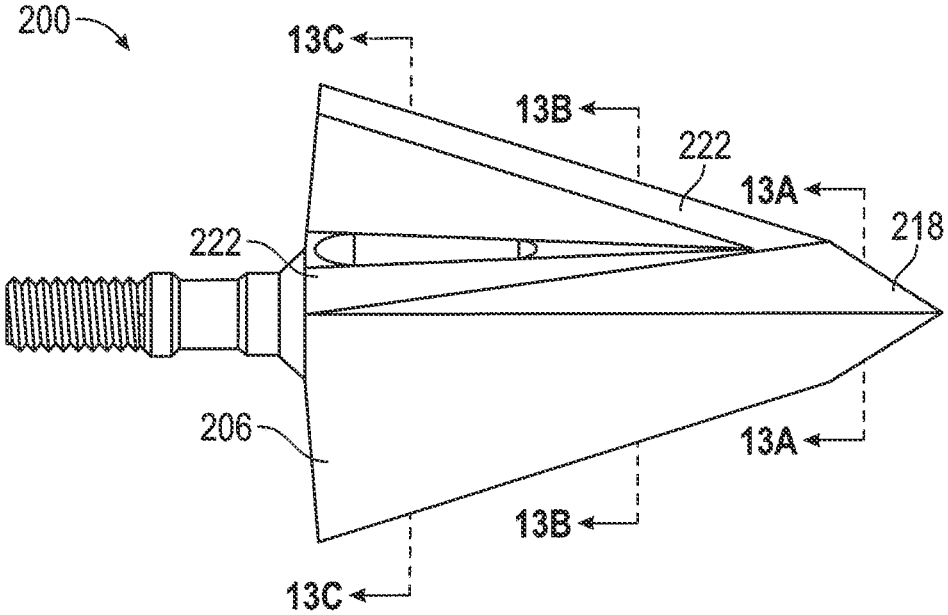
FIG. 12 is a right side view of the broadhead of FIG. 8.
Figure 13A:
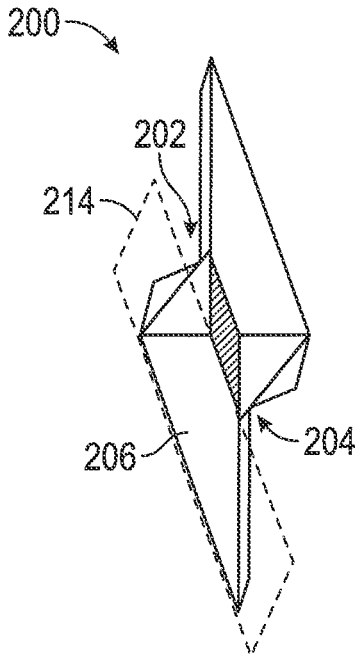
FIG. 13A is a front section view of the broadhead taken along line 13A-13A of FIG. 12.
Figure 13B:
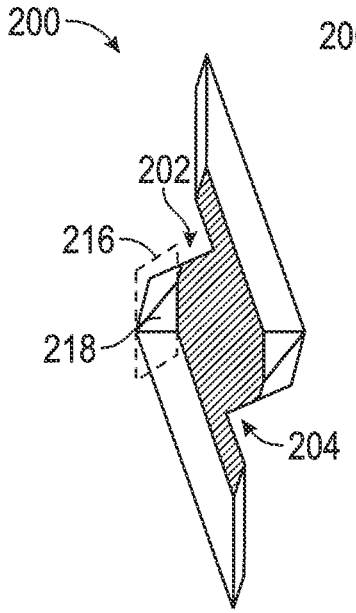
FIG. 13B is a front section view of the broadhead taken along line 13B-13B of FIG. 12.
Figure 13C:
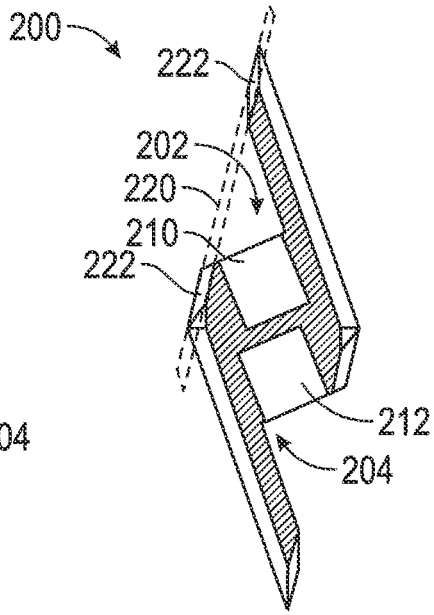
FIG. 13C is a front section view of the broadhead taken along line 13C-13C of FIG. 12.

FIGS. 8-13C show a broadhead 200 according to another embodiment of the present disclosure. Broadhead 200 may replace broadhead 110 in arrow system 100, or broadhead 200 may form part of a different arrow system. As shown in FIGS. 8 and 9, broadhead 200 includes similar features as broadhead 110 and further includes rotationally symmetric relief cut-outs 202 and 204. Cut-outs 202 and 204 provide broadhead 200 with a relatively low mass and facilitate axial rotation of broadhead 200 during penetration by lacking material directly opposite the large rotation-producing primary facet 206 and primary facet 208. As shown in FIGS. 10 and 13C, relief cut-outs 202 and 204 also facilitate use of mass-reducing pocket 210 (FIG. 10) and mass-reducing pocket 212 (FIG. 13C), respectively. FIG. 11 shows upper relief cut-out 202 and lower relief cut-out 204 as viewed from the rear. Relief cut-outs 202 and 204 and mass-reducing pockets 210 and 212 do not alter the planform shape of broadhead 200 shown in FIG. 12, which is the same planform shape shown in FIG. 6 of broadhead 110. FIGS. 13A-13C show corresponding cross-section views of broadhead 200 at the locations indicated in FIG. 12, illustrating further details of relief cut-outs 202 and 204 and the orientation of mass-reducing pockets 210 and 212. In each of FIGS. 13A-13C, a planar parallelogram surface represented by dashed lines is drawn in perspective and in position against the individual facets of broadhead 200. Thus in FIG. 13A, plane 214 is flat against primary facet 206, in FIG. 13B plane 216 lays flat against facet 218, and in FIG. 13C plane 220 lays flat against facet 222. Thus, as indicated in FIG.

13A and FIG. 13C, each of the planes also contains at least one edge of broadhead 200 to be sharpened. Details of an edge sharpening method are described elsewhere herein.

Figure 14:
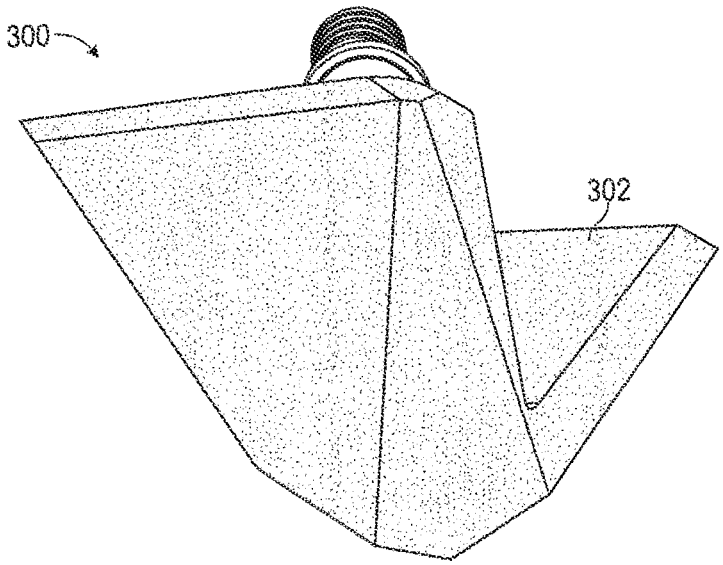
FIG. 14 is a front perspective view of an oxide-coated broadhead before sharpening, according to another embodiment of the present disclosure.
Figure 15:
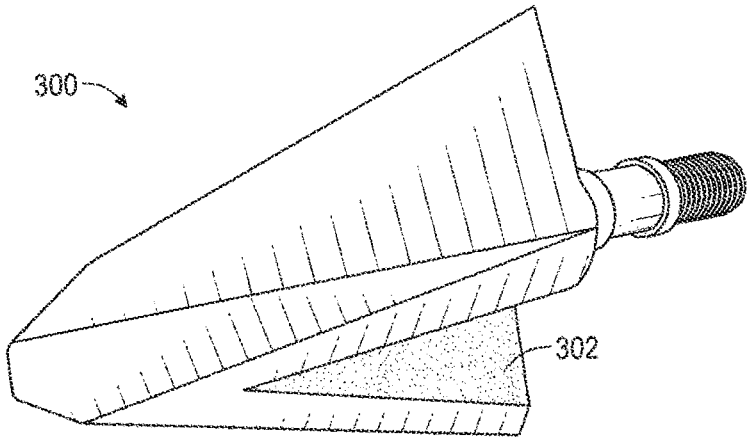
FIG. 15 is a left side perspective view of the oxide-coated broadhead of FIG. 14 after sharpening.

FIGS. 14 and 15 show a broadhead 300 according to another embodiment of the present disclosure. Broadhead 300 may replace broadhead 110 in arrow system 100, or broadhead 300 may form part of a different arrow system. FIG. 14 shows an oxide coating that has been created on broadhead 300 after fabrication and heat treating (i.e., before sharpening). FIG. 15 shows broadhead 300 after being sharpened as described elsewhere herein. In FIG. 15, the oxide coating has been completely removed as a result of the sharpening process except in the area of the visible relief cut-out 302, which remains coated. Broadhead 300 may otherwise be the same as or similar to broadhead 110 or broadhead 200.

Figure 16:
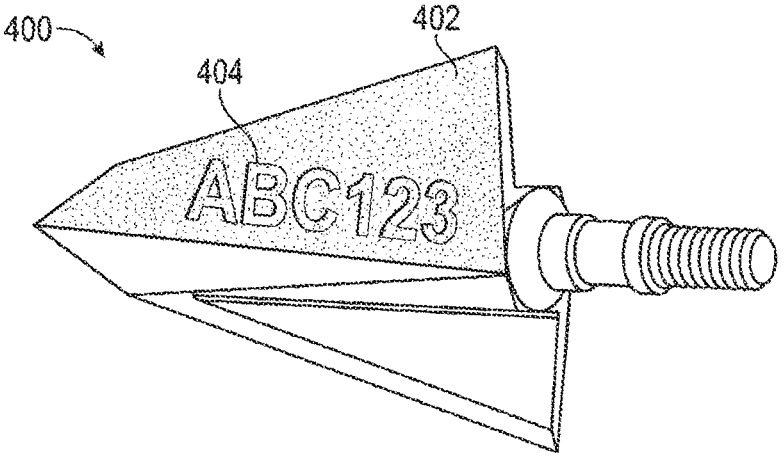
FIG. 16 is a left side perspective view of a broadhead including debossed coated identification markings before sharpening, according to another embodiment of the present disclosure.
Figure 17:
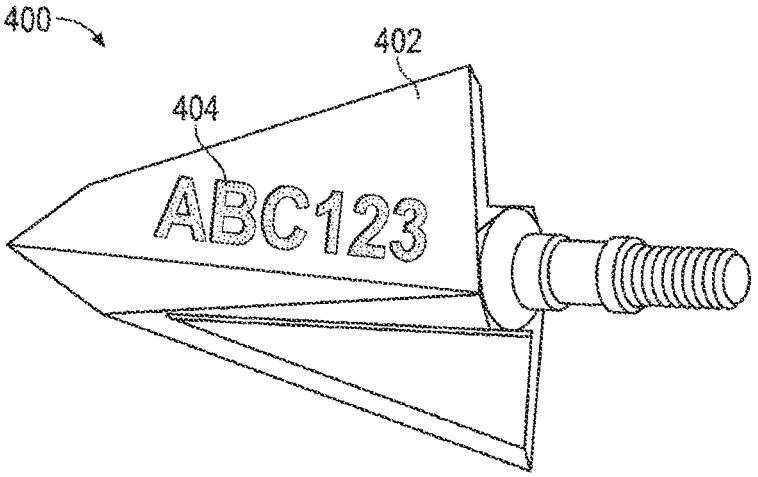
FIG. 17 is a left side perspective view of the broadhead of FIG. 16 after sharpening.

FIGS. 16 and 17 show a broadhead 400 according to another embodiment of the present disclosure. Broadhead 400 may replace broadhead 110 in arrow system 100, or broadhead 400 may form part of a different arrow system. FIG. 16 shows broadhead 400 containing an oxide-coated primary facet 402 along with oxide-coated debossed identification markings 404 after fabrication and heat treating (i.e., before sharpening). FIG. 17 shows broadhead 400 after being sharpened as described elsewhere herein. More specifically, the edges bordering primary facet 402 have been sharpened, thereby highlighting debossed oxide-coated identification markings 404 on the surrounding primary facet where the coating has been removed due to the sharpening process.

Figure 18:
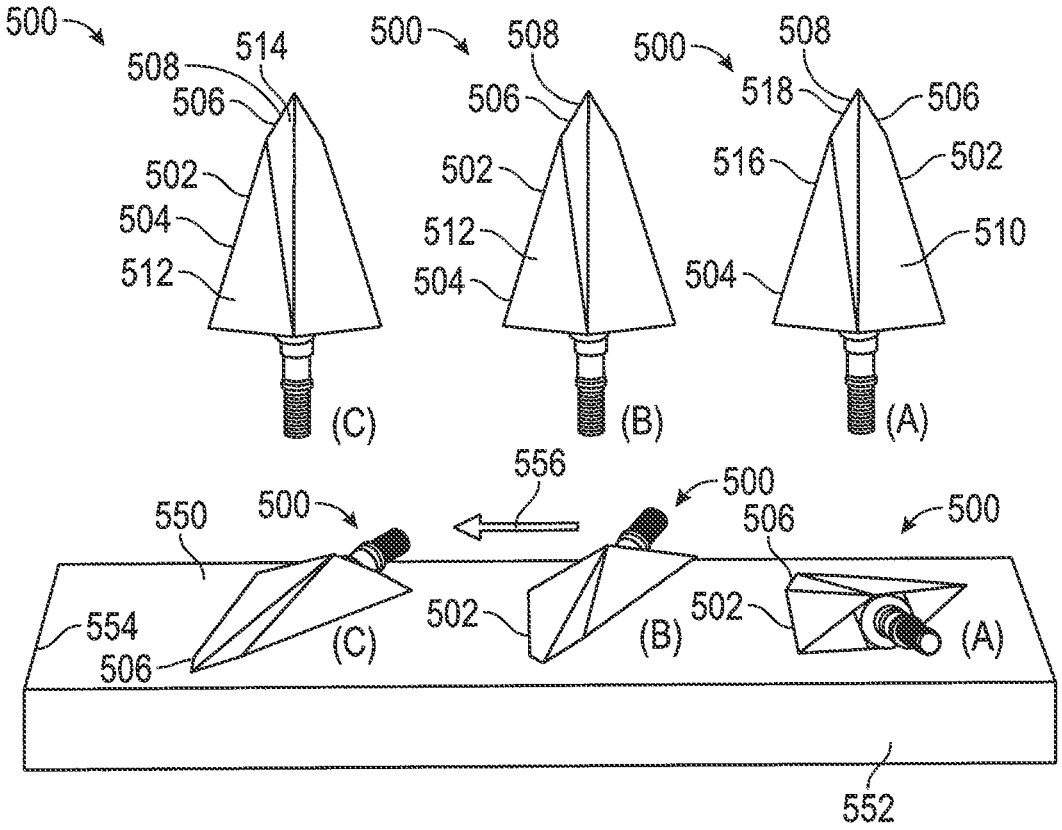
FIG. 18 is a perspective view illustrating steps associated with a process of sharpening a broadhead according to another embodiment of the present disclosure.

FIG. 18 illustrates steps associated with a process of sharpening a broadhead 500. Broadhead 500 may be, for example, the same as or similar to broadhead 110, although the process may also be used to sharpen broadhead 200, broadhead 300, broadhead 400, or any other broadhead contemplated herein. FIG. 18 specifically illustrates a sharpening process for an edge 502 of a trailing portion 504 of broadhead 500 and an edge 506 of a leading portion 508 of broadhead 500. In step (A) a primary facet 510 is placed on a surface 550 of a sharpening stone 552 with edge 502 oriented parallel to an edge 554 of sharpening stone 552. Broadhead 500 is stroked multiple times in the direction of arrow 556. This action sharpens edge 502 and edge 506 but will roll up an edge burr on these edges on the opposite side of broadhead 500 away from sharpening stone 552. This edge burr will subsequently be removed. In step (B) broadhead 500 is flipped over such that facet 512 is placed on surface 550 of sharpening stone 552 with edge 502 oriented parallel to stone edge 554 and stroked in direction of arrow 556. This removes the edge burr on edge 502, but does not remove edge burr on edge 506. In step (C), facet 514 is placed on surface 550 of sharpening stone 552 with edge 506 oriented parallel to stone edge 554 and stroked in the direction of arrow 556. Step (A), step (B), and step (C) are then repeated to sharpen edge 516 and edge 518 to complete the sharpening process for this broadhead 500. The entirety of the process may be repeated with progressively finer grit sharpening stones until the desired edge sharpness is obtained.

Figure 19:
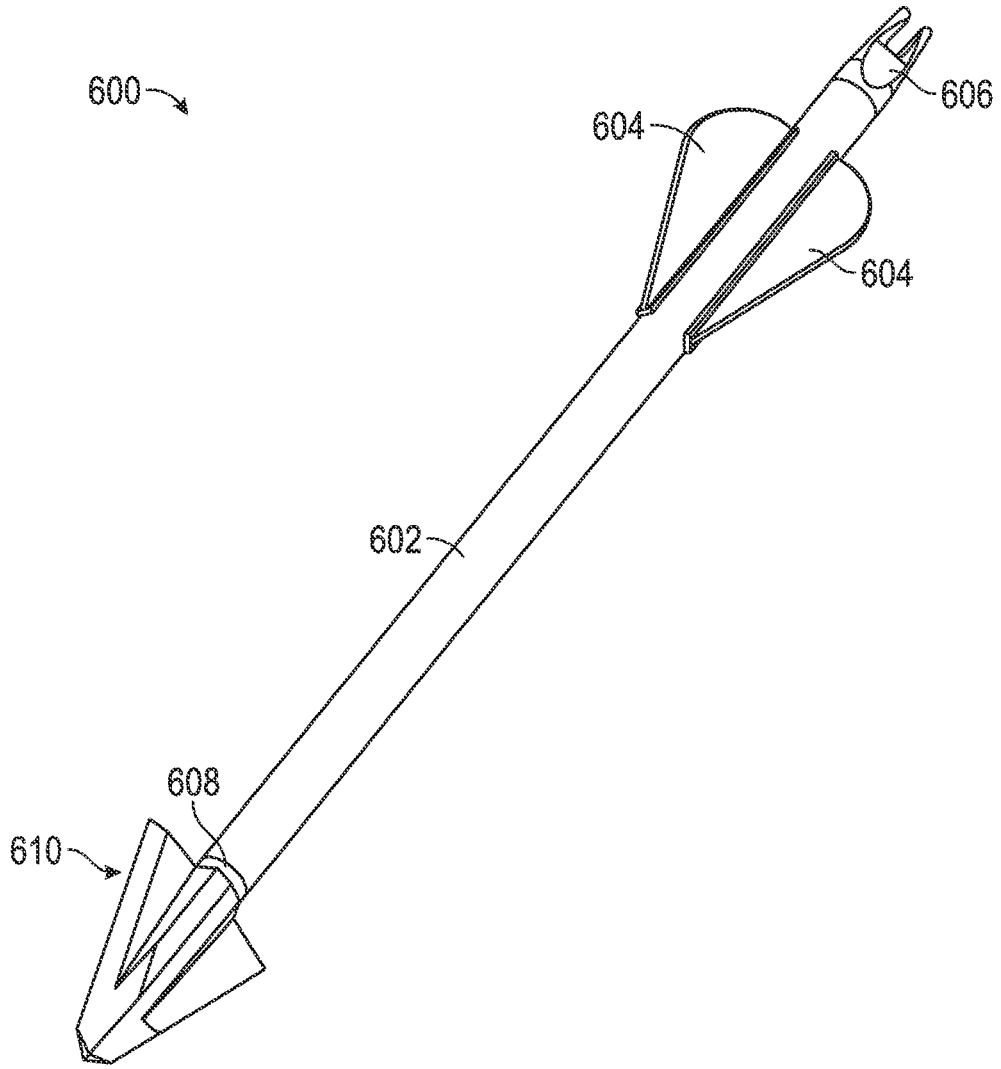
FIG. 19 is a perspective view of an arrow system including a broadhead, an insert, an arrow shaft, a fletching, and a string nock according to another embodiment of the present disclosure.
Figure 20:
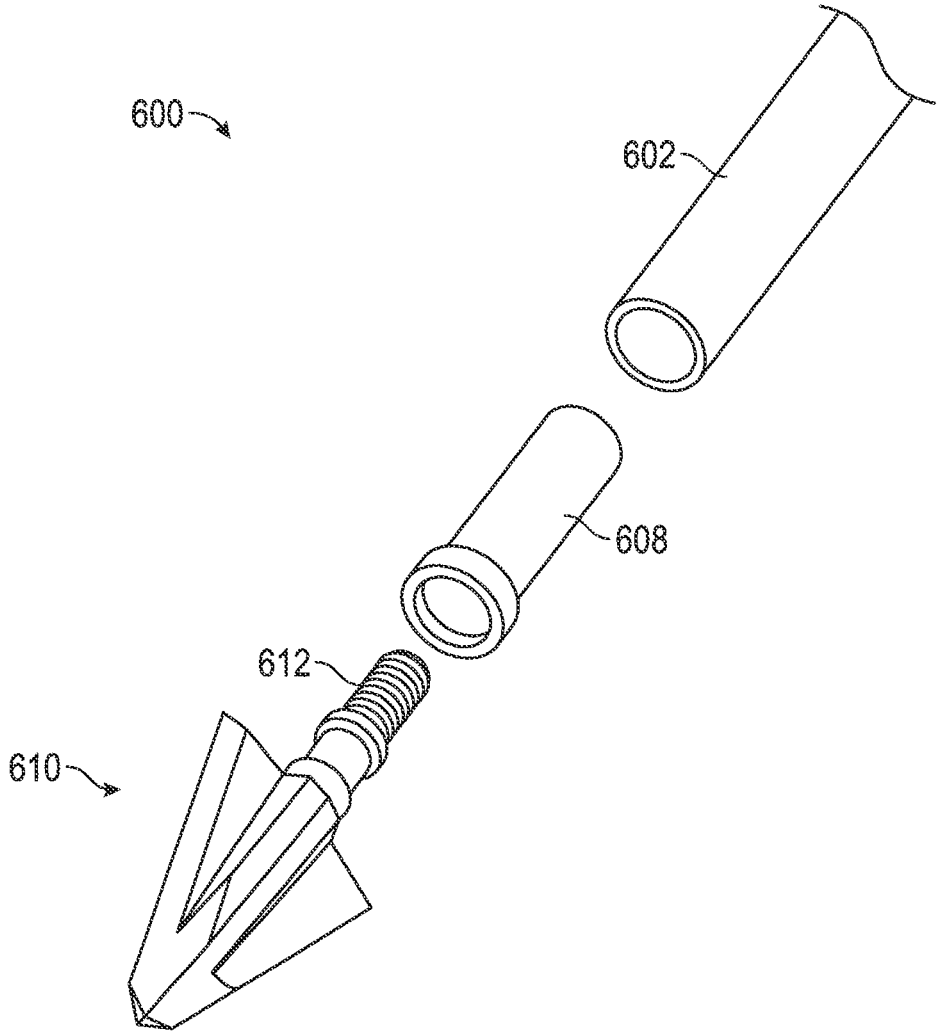
FIG. 20 is an enlarged exploded perspective view of the arrow system of FIG. 19.
Figure 21:
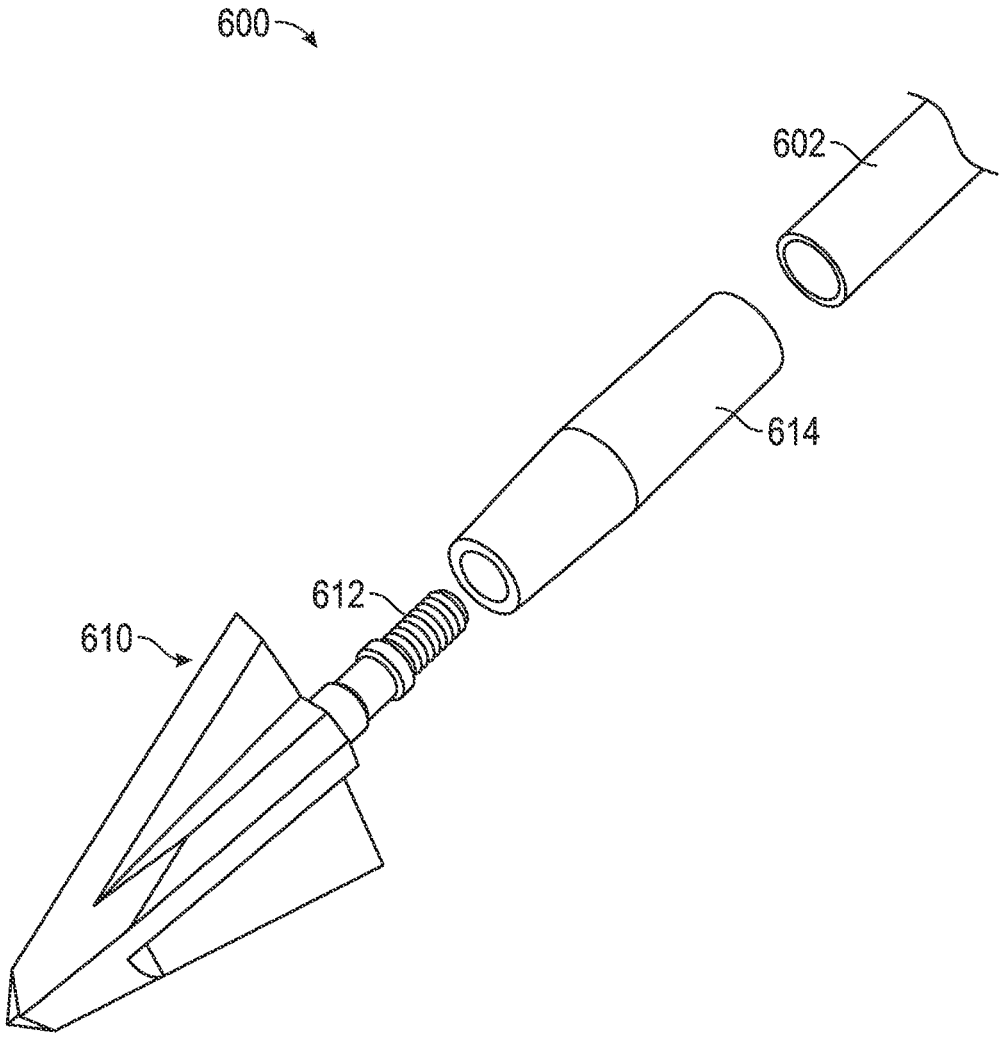
FIG. 21 is an enlarged exploded perspective view of an arrow system including a broadhead, an outsert, and an arrow shaft according to another embodiment of the present disclosure.
Figure 22:
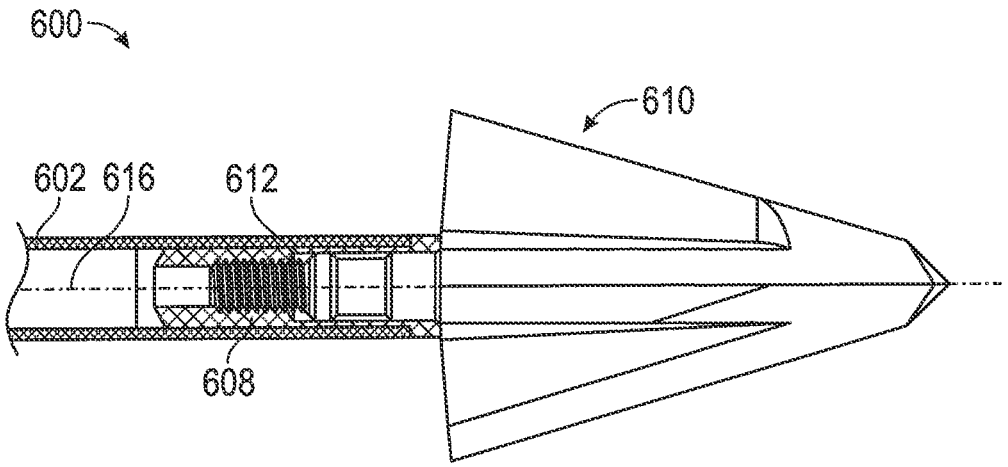
FIG. 22 is a right partial section side view of the arrow system of FIG. 20.
Figure 23:
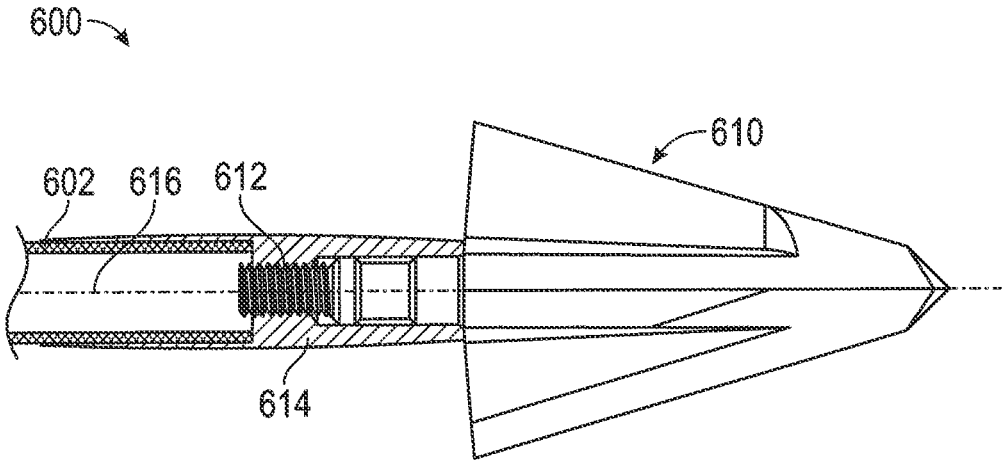
FIG. 23 is a right partial section side view of the arrow system of FIG. 21.

FIGS. 19-31 show an arrow system 600, or components thereof, according to an embodiment of the present disclosure. FIG. 19 shows a perspective view of arrow system 600, which includes an arrow shaft 602, a fletching 604, a string nock 606, and an insert 608 which threadably receives a broadhead 610 that includes face-facet sharpening features. Arrow shaft 602, fletching 604, string nock 606, and insert 608 may take any conventional form known to those of ordinary skill in the art. FIG. 20 shows an enlarged exploded view of arrow system 600. Insert 608 may be glued into arrow shaft 602, and broadhead 610 may be threadably attached via threaded integral stem 612 to insert 608 and, as a result, is easily removed for sharpening or for replacement. FIG. 21 shows an alternative construction of arrow system 600 in which insert 608 is replaced by an outsert 614 which internally receives glued-in arrow shaft 602 at the proximal end of outsert 614 and threadably receives threaded integral stem 612 of broadhead 610 on the distal end of outsert 614. Outsert 614 may take any conventional form known to those of ordinary skill in the art. FIG. 22 and FIG. 23 are section views of arrow shaft 602 and insert 608 and arrow shaft 602 and outsert 614, respectively, showing the installed position of broadhead 610 along a central or longitudinal axis 616 for each construction.

Figure 24:
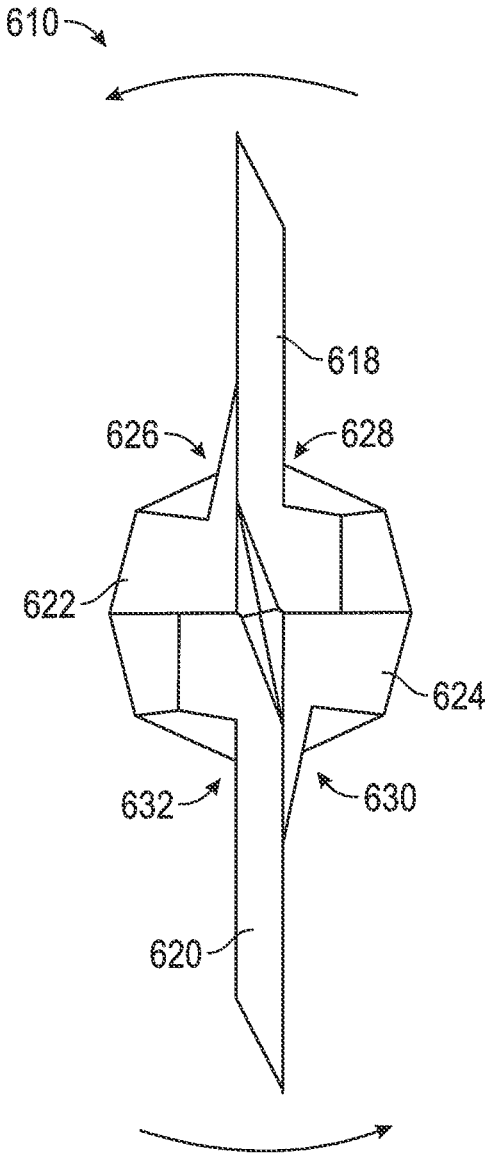
FIG. 24 is a front view of the broadhead of FIG. 19.
Figure 25:
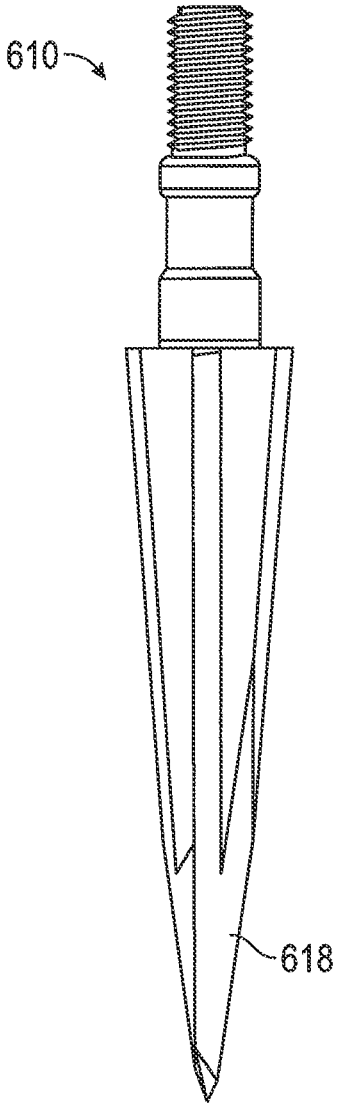
FIG. 25 is a top view of the broadhead of FIG. 19.

FIG. 24 shows a front view of broadhead 610. Broadhead 610 includes 180-degree axially rotational (i.e., diagonal) symmetry such that a first primary facet 618, if rotated through 180 degrees around central axis 616 (FIG. 22 etc.) would overlap a second primary facet 620, a first auxiliary facet 622 would overlap a second auxiliary facet 624, and similarly cutout 626 and cutout 628 would overlap cutout 630 and cutout 632, respectively. First primary facet 618 and second primary facet 620 present the most surface area as viewed in FIG. 24 compared to all other facets, and as a result combine to produce a relative counterclockwise rotation around central axis 616 during penetration as indicated by the arrows. This rotation is due to the greater force exerted on these particular facets by the target. FIG. 25 also shows the relative size of primary facet 618 of broadhead 610. These large rotation-producing primary facets are an advantageous feature of broadhead 610 because the induced rotation helps to split and separate bone structure which allows unimpeded penetration of arrow shaft 602. As also shown in FIG. 25, broadhead 610 as viewed from the top incorporates a smoothly transitioning, high mechanical advantage wedge-shaped body which further aids in splitting and separating bone structure, functioning in a way similar to how an axe or a maul splits wood.

Figure 26:
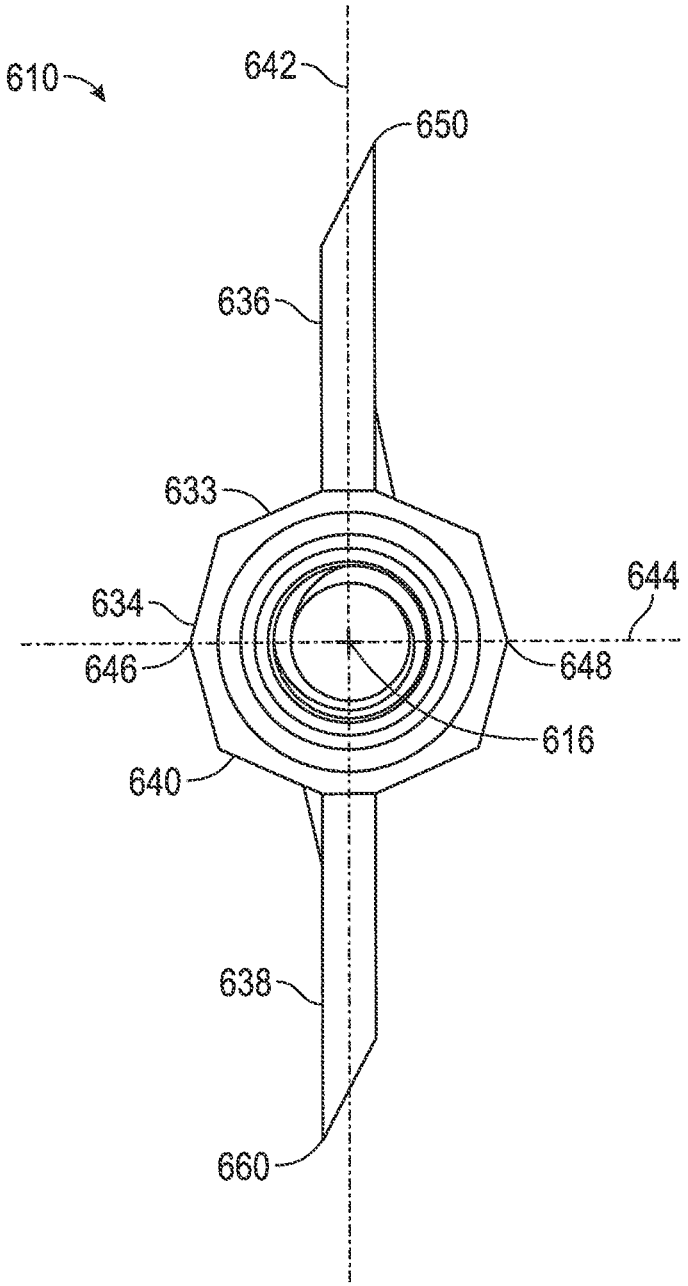
FIG. 26 is a rear view of the broadhead of FIG. 19.

FIG. 26 shows a rear view of broadhead 610. FIG. 26 shows that broadhead 610 includes a body 633 that monolithically forms a central ferrule 634, a first blade 636 coupled to ferrule 634, and a second blade 638 coupled to ferrule 634 opposite first blade 636. Blades 636 and 638, at least at a rear or trailing portion 640 of broadhead 610, are centrally aligned with a vertical midplane 642 in which central axis 616 lies. Vertical midplane 642 is rotationally offset, around central axis 616, from a first cutting edge 650 of first blade 636 and a second cutting edge 660 of second cutting blade 638. Vertical midplane 642 is perpendicular to a horizontal midplane 644 of broadhead 610, in which central axis 616 also lies. Horizontal midplane 644 also intersects with opposite edges 646, 648 across the narrow dimension of broadhead 610.

Figure 27:
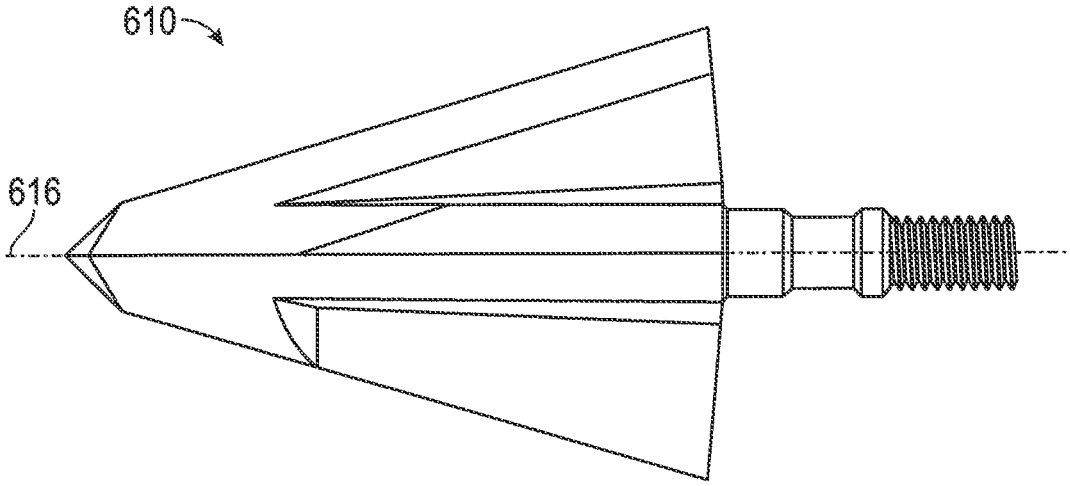
FIG. 27 is a left side view of the broadhead of FIG. 19.
Figure 28:
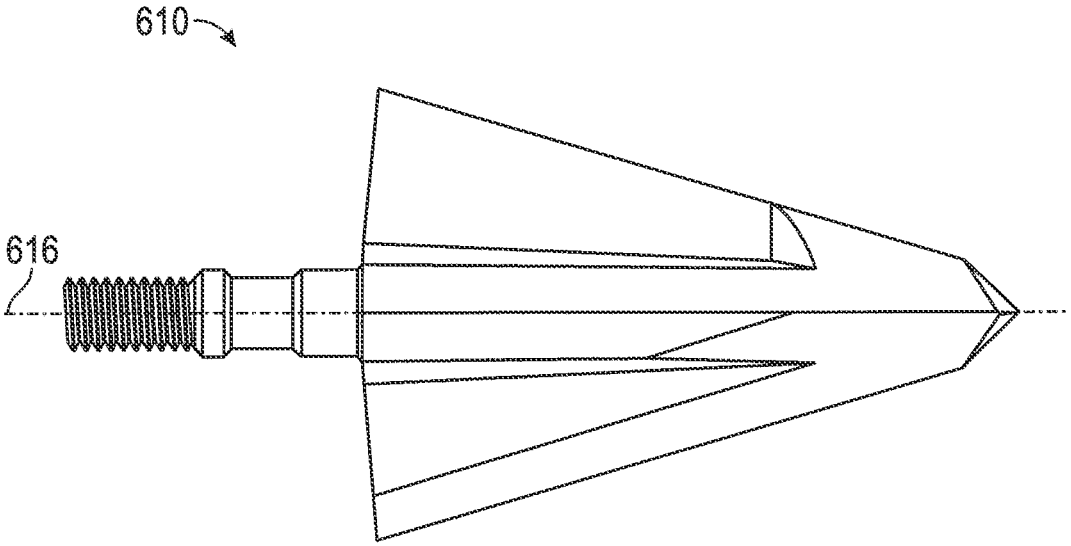
FIG. 28 is a right side view of the broadhead of FIG. 19.

FIG. 27 shows the left side profile of broadhead 610 and FIG. 28 shows the right side profile of broadhead 610. FIGS. 27 and 28 illustrate the rotationally symmetric layout of the facets about central axis 616 of broadhead 610.

Figure 29A:
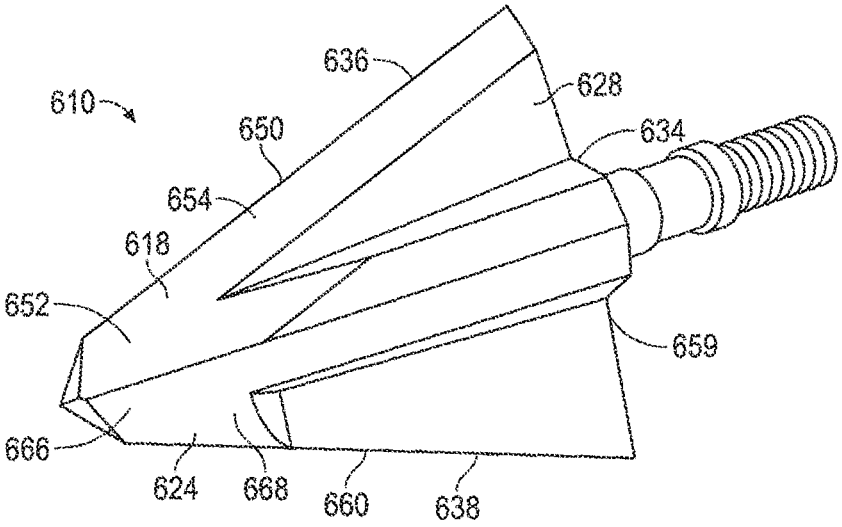
FIG. 29A is a left side perspective view of the broadhead of FIG. 19.
Figure 29B:
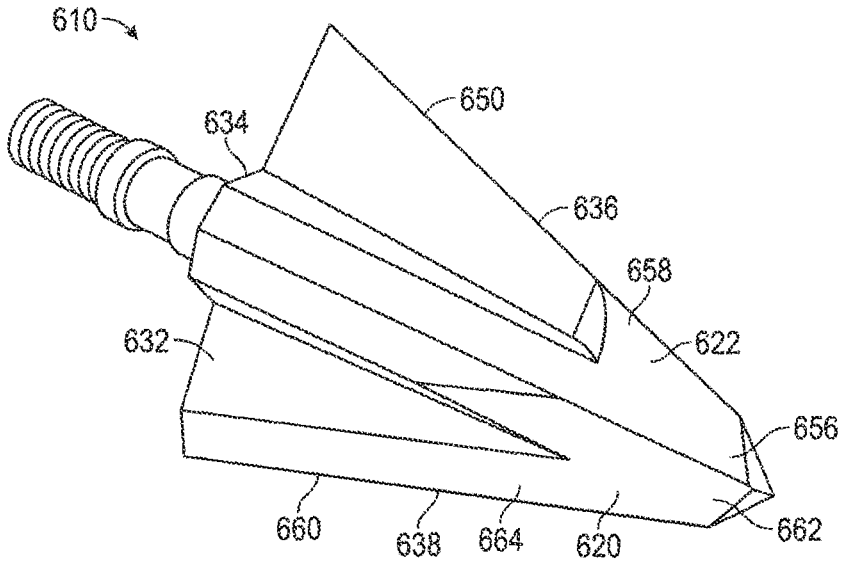
FIG. 29B is a right side perspective view of the broadhead of FIG. 19.

Referring again to FIG. 24, broadhead 610 includes a series of diagonally symmetric facets 618, 620, 622, 624 and machined cutouts 626, 628, 630, 632. In addition, FIG. 29A and FIG. 29B illustrate first cutting edge 650, which is sharpened when first primary facet 618 and first auxiliary facet 622 are alternatingly laid flat against a flat sharpening stone and stroked. Stated another way, facets 618 and 622 are both partially bound by first cutting edge 650. Facet 618 includes a first primary facet portion 652 formed on ferrule 634 and a second primary facet portion 654 formed on first blade 636, and first primary facet portion 652 and second primary facet portion 654 together define a first planar surface. Similarly, facet 622 includes a first auxiliary facet portion 656 formed on ferrule 634 and a second auxiliary facet portion 658 formed on first blade 636, and first auxiliary facet portion 656 and second auxiliary facet portion 658 together define a second planar surface. The first and second planar surfaces are alternatingly laid against and contact the surface of a sharpening stone when sharpening first cutting edge 650.

With specific reference to FIG. 29A, first primary facet portion 652 may have a length that is one of various percentages of an overall length of broadhead 610 (i.e., the length of broadhead 610 between a tip portion defined by ferrule 634 and an aft end portion 659 defined by blades 636, 638). For example, the first facet portion length may be as low as 45 percent, 47 percent, or 49 percent of the broadhead length and as high as 96 percent, 98 percent, or 100 percent of the broadhead length, or may be encompassed by a range including any two of the foregoing percentages as endpoints. Second primary facet portion 654 may have a length that is one of various percentages of the overall length of broadhead 610. For example, the second facet portion length may be as low as 81 percent, 83 percent, or 85 percent of the broadhead length and as high as 96 percent, 98 percent, or 100 percent of the broadhead length, or may be encompassed by a range including any two of the foregoing percentages as endpoints. Cutout 628 partially separates first primary facet portion 652 from second primary facet portion 654. Cutout 628 may have a length that is one of various percentages of the overall length of broadhead 610. For example, the cutout length may be as low as 50 percent, 52 percent, or 54 percent of the broadhead length and as high as 81 percent, 83 percent, or 85 percent of the broadhead length, or may be encompassed by a range including any two of the foregoing percentages as endpoints.

FIG. 29A and FIG. 29B also illustrate second cutting edge 660, which is similarly sharpened when second primary facet 620 and second auxiliary facet 624 are alternatingly laid flat upon a flat sharpening stone and stroked. Stated another way, facets 620 and 624 are both partially bound by second cutting edge 660. Facet 620 includes a first primary facet portion 662 formed on ferrule 634 and a second primary facet portion 664 formed on second blade 638, and first primary facet portion 662 and second primary facet portion 664 together define a first planar surface. Similarly, facet 624 includes a first auxiliary facet portion 666 formed on ferrule 634 and a second auxiliary facet portion 668 formed on second blade 638, and first auxiliary facet portion 666 and second auxiliary facet portion 668 together define a second planar surface. The first and second planar surfaces are alternatingly laid against and contact the surface of a sharpening stone when sharpening second cutting edge 660.

With specific reference to FIG. 29B, first primary facet portion 662 may have a length that is one of various percentages of the overall length of broadhead 610. For example, the first facet portion length may be as low as 45 percent, 47 percent, or 49 percent of the broadhead length and as high as 96 percent, 98 percent, or 100 percent of the broadhead length, or may be encompassed by a range including any two of the foregoing percentages as endpoints. Second primary facet portion 664 may have a length that is one of various percentages of the overall length of broadhead 610. For example, the second facet portion length may be as low as 81 percent, 83 percent, or 85 percent of the broadhead length and as high as 96 percent, 98 percent, or 100 percent of the broadhead length, or may be encompassed by a range including any two of the foregoing percentages as endpoints. Cutout 632 partially separates first primary facet portion 662 from second primary facet portion 664. Cutout 632 may have a length that is one of various percentages of the overall length of broadhead 610. For example, the cutout length may be as low as 50 percent, 52 percent, or 54 percent of the broadhead length and as high as 81 percent, 83 percent, or 85 percent of the broadhead length, or may be encompassed by a range including any two of the foregoing percentages as endpoints.

Figure 30:
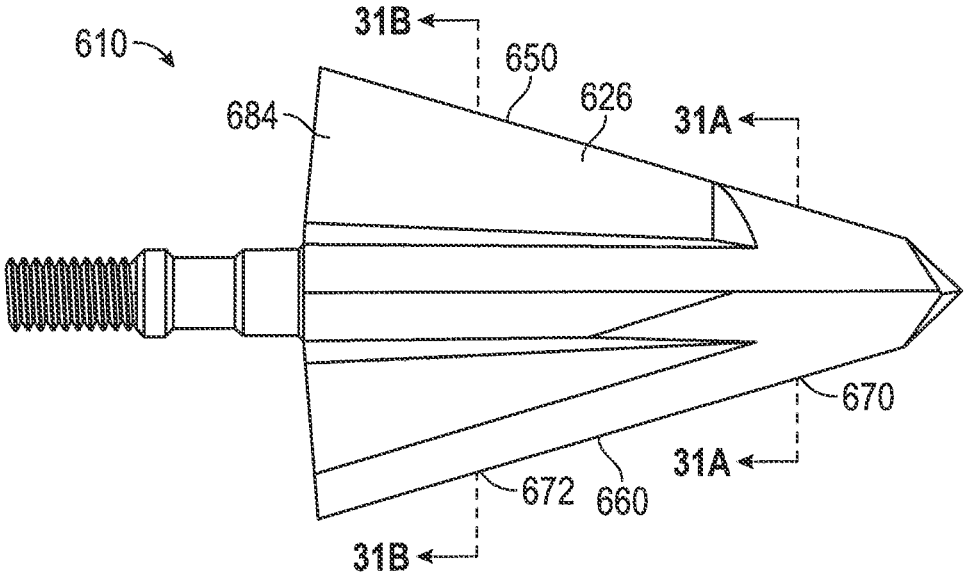
FIG. 30 is a right side view of the broadhead of FIG. 19.
Figure 31A:
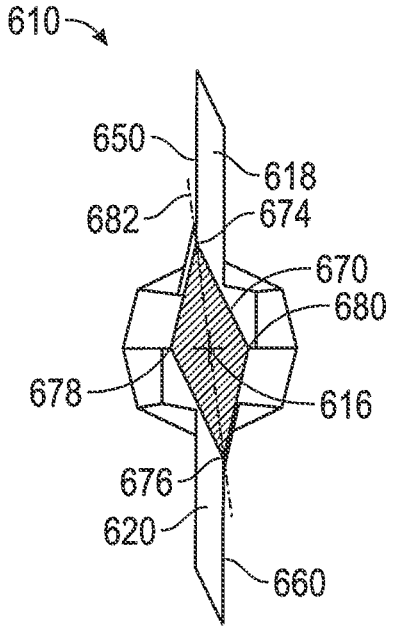
FIG. 31A is a front section view of the broadhead taken along line 31A-31A of FIG. 30.

Referring to FIG. 30, each lengthwise section of broadhead 610 (i.e., a leading portion 670 and a trailing portion 672) is constructed to perform a specific task. More specifically, leading portion 670 includes a relatively large cross-sectional area such that broadhead 610 can withstand impact with bone and rocky soil without deforming. Leading portion 670 may have a length that is, for example, about ⅓ of the overall length of broadhead 610. More specifically, the leading portion length may be as low as 18 percent, 23 percent, or 28 percent of the broadhead length and as high as 38 percent, 43 percent, or 48 percent of the broadhead length, or may be encompassed by a range including any two of the foregoing percentages as endpoints. As shown in FIGS. 30 and 31A, leading portion 670 has a double-bevel configuration. Stated another way, the cross section of leading portion 670 of broadhead 610 is a parallelogram shape, more specifically an asymmetric, rotated diamond shape. Stated yet another way and referring specifically to FIG. 31A, leading portion 670 has a cross-sectional area, more specifically a parallelogram-shaped cross-sectional area, having a first vertex 674, a second vertex 676 opposite first vertex 674, a third vertex 678, and a fourth vertex 680 opposite third vertex 678, broadhead 610 includes a diagonal midplane 682 in which central axis 616 lies, diagonal midplane 682 is rotationally offset from vertical midplane 642 (FIGS. 26 and 31B), and diagonal midplane 682 bisects the cross-sectional area and intersects with first vertex 674 and second vertex 676. Diagonal midplane 682 may be rotationally offset from vertical midplane 642 by as low as 3 degrees or 5 degrees and as high as 11 degrees or 13 degrees, or may be encompassed by a range including any two of the foregoing angles as endpoints. First cutting edge 650 of first blade 636 defines first vertex 674 of the cross-sectional area, and second cutting edge 660 of second blade 638 defines second vertex 676 of the cross-sectional area. The shape of leading portion 670 provides relatively high strength to leading portion 670 due to the relatively large thickness near cutting edges 650 and 660. Relatedly, the shape of leading portion 670 adds robustness to broadhead 610 during an impact event due to the relatively large cross-sectional area of the shape. Furthermore, the shape of leading portion 670 causes broadhead 610 to initiate rotation when moving through a target due to pressure exerted by primary facets 618 and 620 on the target. This rotation advantageously facilitates splitting bone during impact. In contrast, on previous double bevel broadheads, the centerline is typically oriented vertically and parallel to the blades' side faces such that the bevel is symmetric about the centerline and therefore does not generate bone-splitting rotational forces during impact.

Figure 31B:
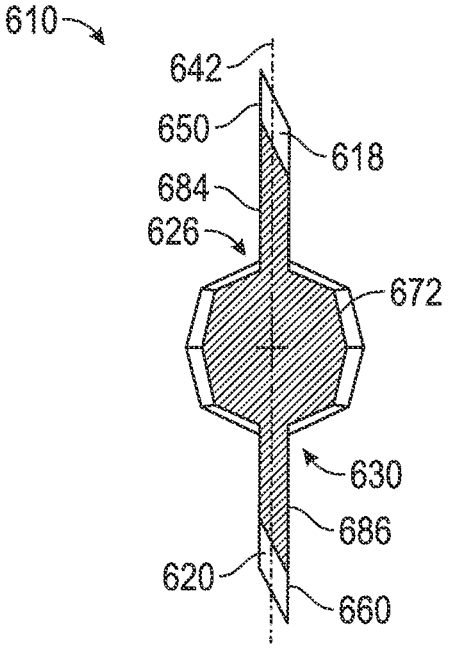
FIG. 31B is a front section view of the broadhead taken along line 31B-31B of FIG. 30.

As shown in FIG. 30 and FIG. 31B, trailing portion 672 of broadhead 610 includes a cross-sectional shape that differs from that of leading portion 670. More specifically, trailing portion 672 has a single-bevel configuration. Even more specifically, first cutting edge 650 is a single beveled edge formed at the intersection of first primary facet 618 and a side facet 684 adjacent cutout 626. Likewise, second cutting edge 660 is a single beveled edge formed at the intersection of first primary facet 620 and a side facet 686 (FIG. 31B) adjacent cutout 630. The single beveled edges of trailing portion 672 of broadhead 610 are sharper but structurally weaker than the double bevel edges of leading portion 670 due to the shallower blade angle of trailing portion 672 compared to the double bevel edges of leading portion 670. Trailing portion 672 may have a length that is, for example, about ⅔ of the overall length of broadhead 610. More specifically, the trailing portion length may be as low as 51 percent, 56 percent, or 61 percent of the broadhead length and as high as 71 percent, 76 percent, or 81 percent of the broadhead length, or may be encompassed by a range including any two of the foregoing percentages as endpoints.

Figure 32:
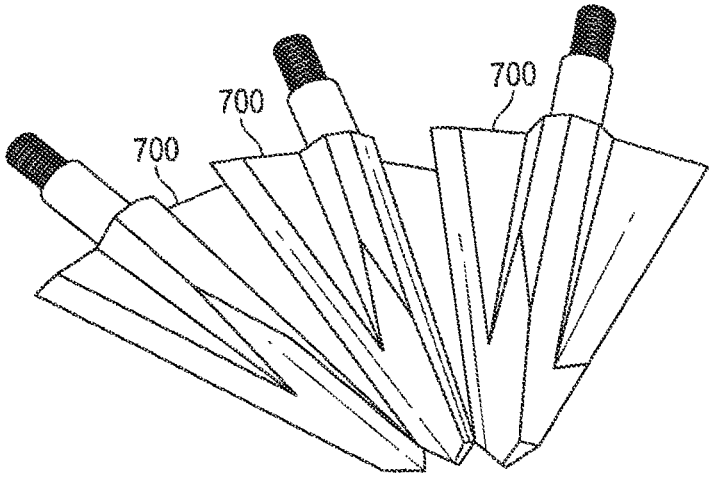
FIG. 32 is a perspective view of multiple broadheads according to another embodiment of the present disclosure.

FIG. 32 illustrates multiple broadheads 700 according to an embodiment of the present disclosure. Broadheads 700 may be constructed from steel. Broadheads 700 may otherwise be the same or similar to broadhead 610.

Figure 33:
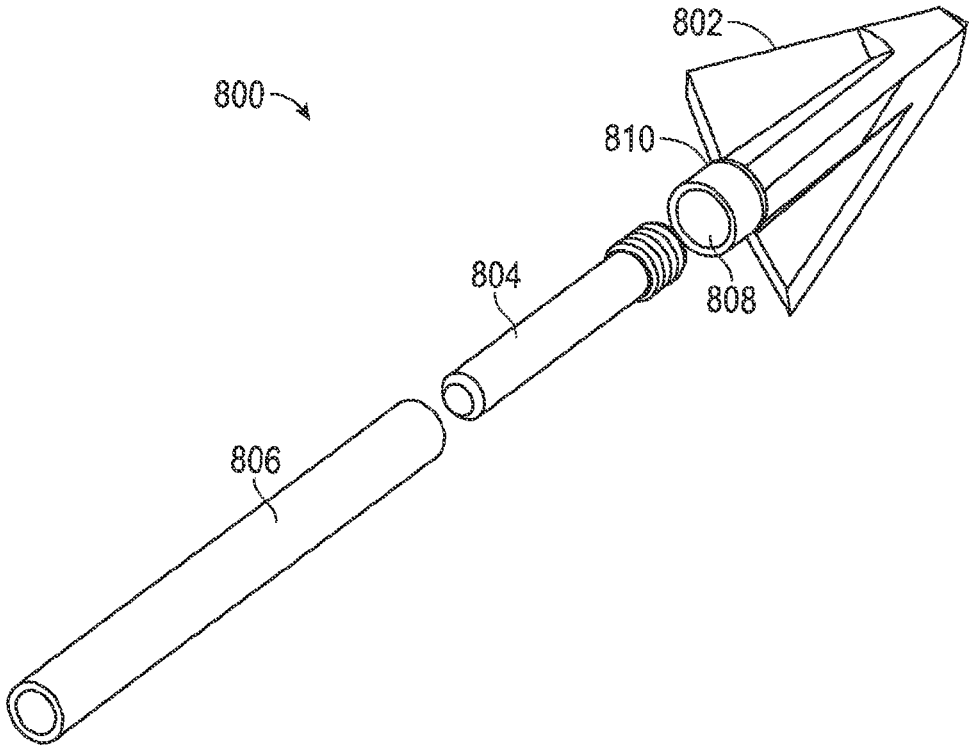
FIG. 33 is an exploded rear perspective view of an arrow system including a broadhead, a separate glue-in stem, and an arrow shaft according to another embodiment of the present disclosure.

FIG. 33 shows an arrow system 800 according to another embodiment of the present disclosure. Arrow system includes a broadhead 802 that threadably attaches to the distal end of a stem insert 804, and insert 804 is also internally received and bonded into an arrow shaft 806. Shaft 806 is also tightly received via a friction fit into a bored-out cavity, or attachment bore, 808 of a ferrule 810 of broadhead 802. Broadhead 802 may otherwise be the same as or similar to any of the broadheads contemplated herein, such as broadhead 610.

Figure 34:
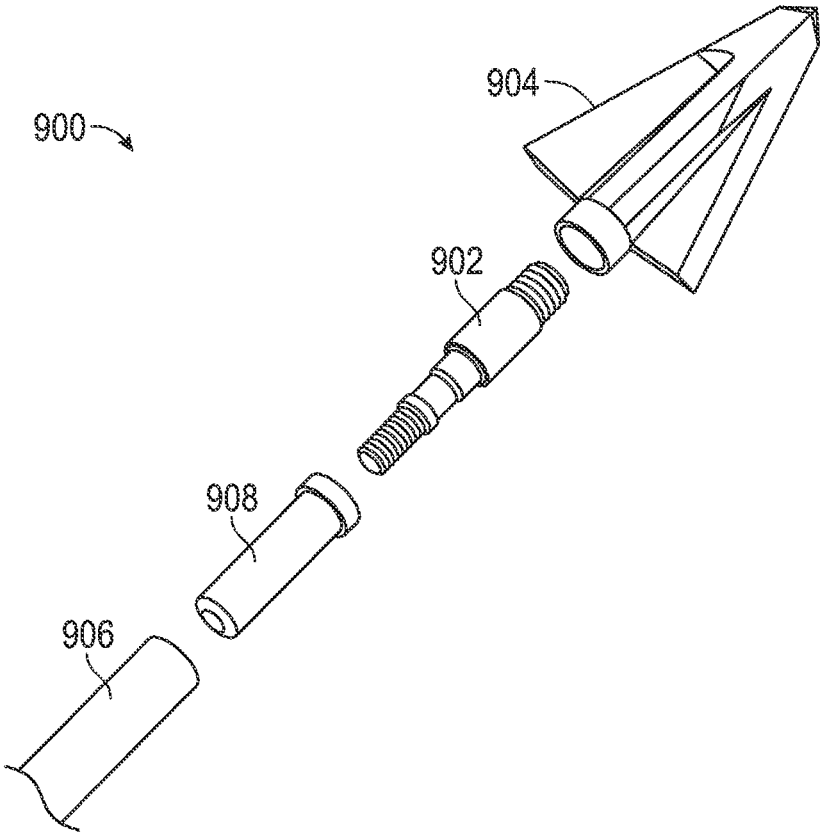
FIG. 34 is an exploded rear perspective view of another arrow system including a broadhead, an insert, a separate threaded stem, and an arrow shaft according to another embodiment of the present disclosure.
Figure 35:
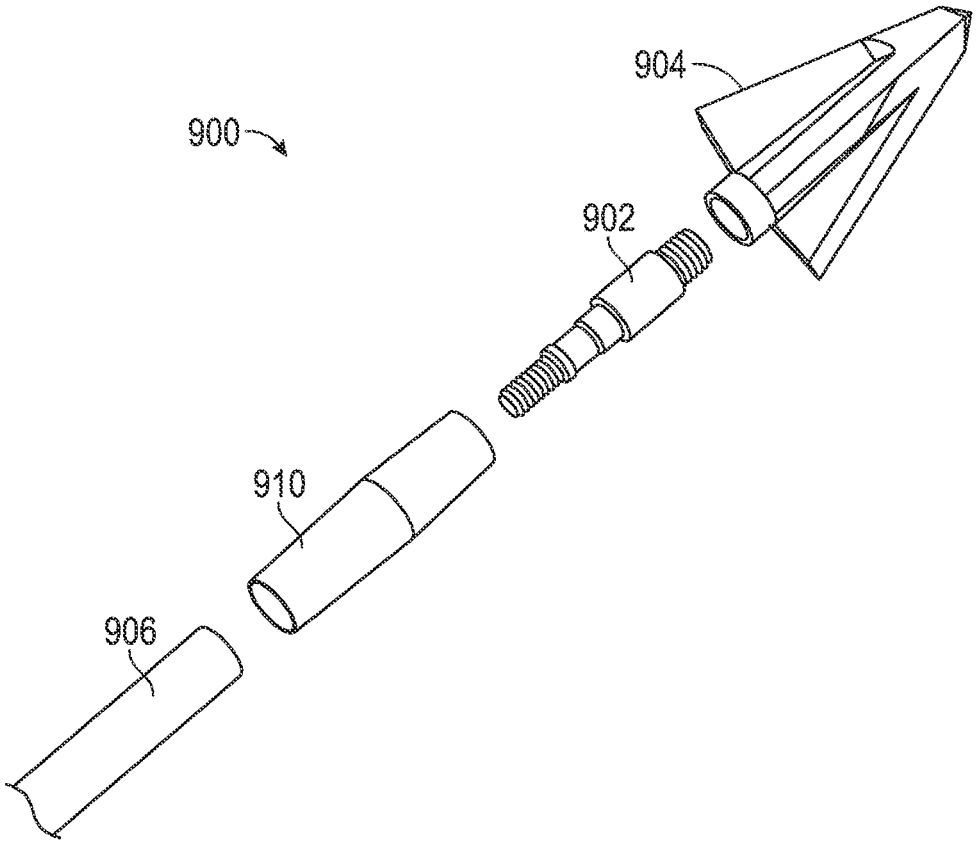
FIG. 35 is an exploded rear perspective view of yet another arrow system including a broadhead, an outsert, a separate threaded stem, and an arrow shaft according to another embodiment of the present disclosure.

The manner of joining broadhead 802 to arrow shaft 806 advantageously provides relatively high structural integrity for arrow system 800. However, it is common practice for archers to purchase pre-built arrows shafts having either an insert or outsert already installed. In these situations, stem insert 804 cannot be used to connect broadhead 802 to arrow shaft 806. FIGS. 34 and 35 illustrate an arrow system 900 for use in such situations. Arrow system 900 includes a universal threaded adapter 902 that threadably connects a broadhead 904 to an arrow shaft 906 via both of an insert 908 (FIG. 34) and an outsert 910 (FIG. 35). Broadhead 904 may otherwise be the same as or similar to any of the broadheads contemplated herein, such as broadhead 610.

Figure 36:
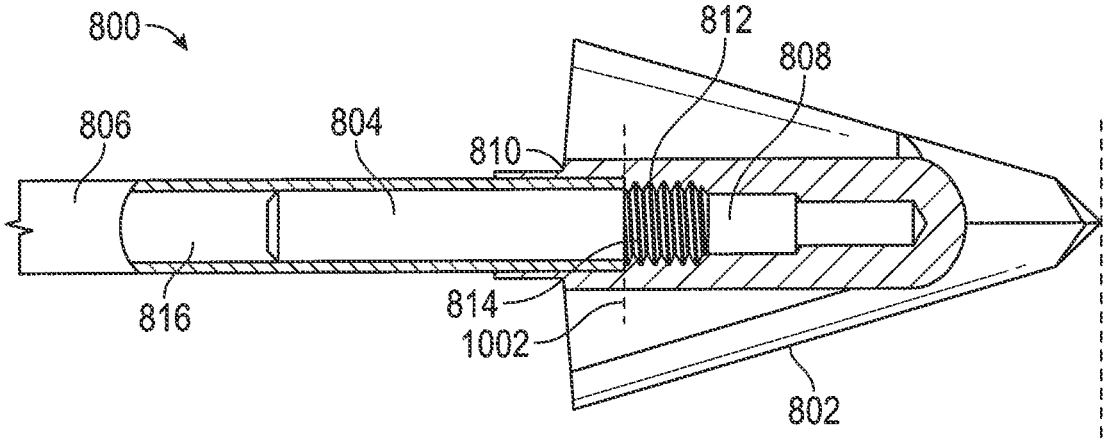
FIG. 36 is a right partial section side view of the arrow system of FIG. 33.
Figure 37:
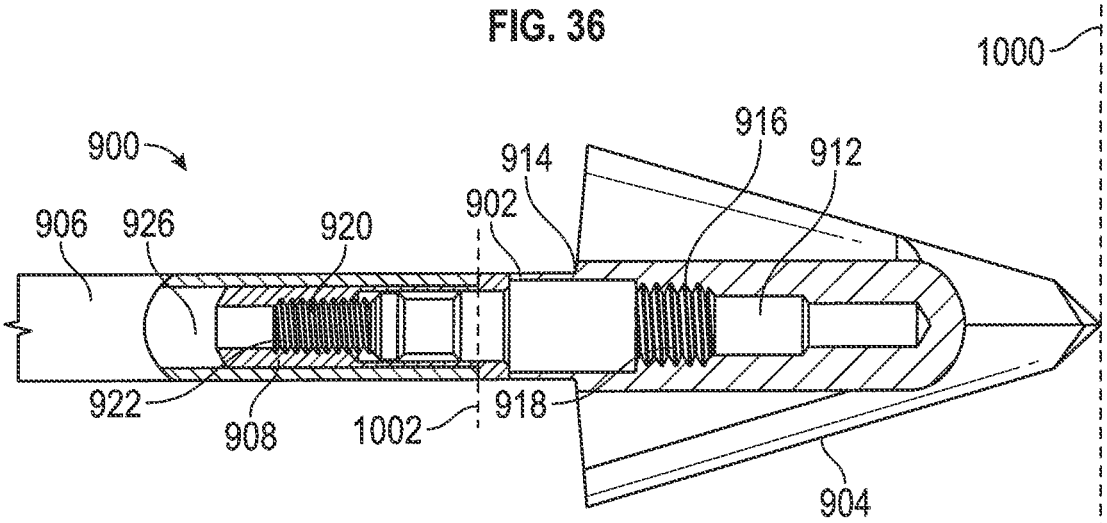
FIG. 37 is a right partial section side view of the arrow system of FIG. 34.
Figure 38:
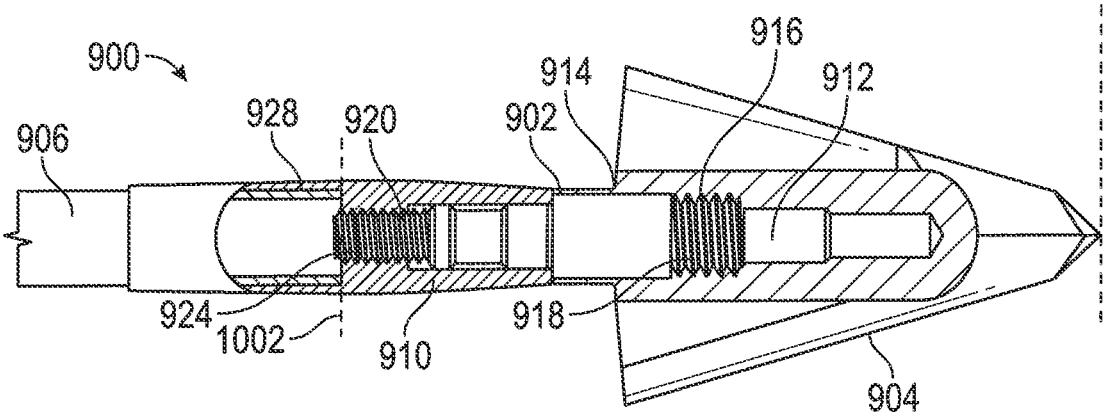
FIG. 38 is a right partial section side view of the arrow system of FIG. 35.

FIG. 36 is a partial section side view of arrow system 800, FIG. 37 is a partial section side view of arrow system 900 using insert 908, and FIG. 38 is a partial section side view of arrow system 900 using outsert 910. Referring specifically to FIG. 36, cavity 808 of ferrule 810 of broadhead 802 includes an internal threaded surface 812 that threadably couples to an external threaded surface 814 of insert 804 to secure insert 804 to broadhead 802. Arrow shaft 806 includes a cavity, or attachment bore, 816 that slidably receives insert 804 and in which insert 804 is bonded to arrow shaft 806.

Referring specifically to FIGS. 37 and 38, a cavity 912 of a ferrule 914 of broadhead 904 includes an internal threaded surface 916 that threadably couples to a first external threaded surface 918 of adaptor 902 to secure adaptor 902 to broadhead 904. Adaptor 902 further includes a second external threaded surface 920 opposite first external threaded surface 918. Second external threaded surface 920 of adaptor 902 is configured to threadably couple to both (1) an internal threaded surface 922 of insert 908 (FIG. 37) to secure insert 908 to adaptor 902, and (2) an internal threaded surface 924 of outsert 910 (FIG. 38) to secure outsert 910 to adaptor 902. Arrow shaft 906 includes a cavity, or attachment bore, 926 that is configured to slidably receive insert 908 (FIG. 37) and in which insert 908 is bonded to arrow shaft 906, and outsert 910 (FIG. 38) includes a cavity, or attachment bore, 928 that is configured to slidably receive arrow shaft 906 and in which arrow shaft 906 is bonded to outsert 910.

With collective reference to FIGS. 36-38, the relative distance between a first vertical line 1000 and a second vertical line 1002 in each view indicates the installed position of broadhead 802 or 904 in relationship to the end of arrow shaft 806 or 906, respectively. Insert 804 produces the least distance between the tip of broadhead 802 and the end of arrow shaft 806, outsert 910 produces the greatest separation distance, and insert 908 produces a distance between the two bounds. If a constant transverse force is applied to the tip of broadhead 802 or 904, the torque produced at arrow shaft end 806 or 906 will be greatest for arrow system 900 using outsert 910, least for arrow system 800, and an intermediate value for arrow system 900 using insert 908.

Figure 39:
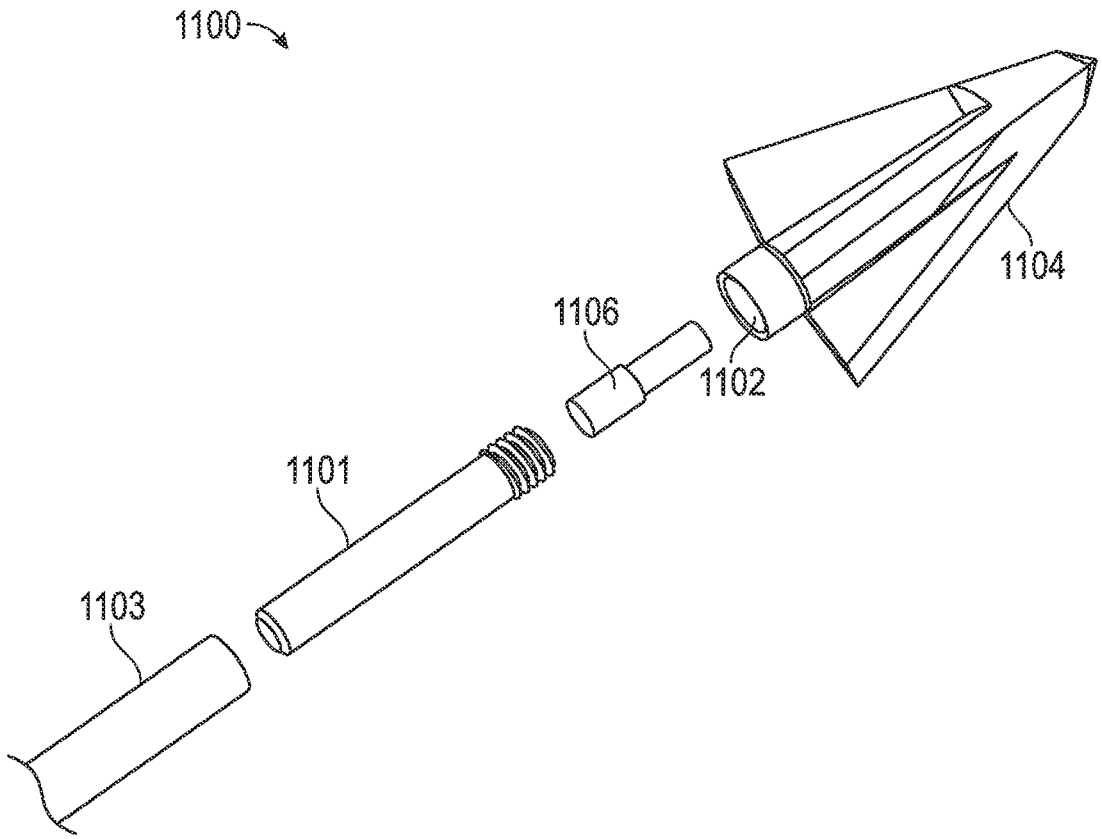
FIG. 39 is an exploded rear perspective view of an arrow system including a broadhead, a separate core weight, a separate glue-in stem, and arrow shaft according to another embodiment of the present disclosure.
Figure 40:
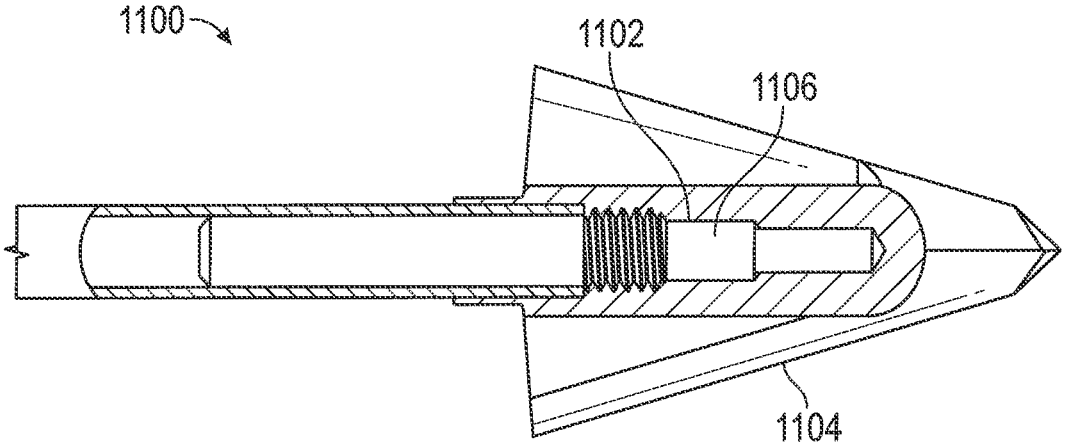
FIG. 40 is a right partial section side view of the arrow system of FIG. 39.

FIGS. 39 and 40 show an arrow system 1100 according to another embodiment of the present disclosure. Arrow system 1100 may be the same as or similar to arrow system 800 (for example, by including a stem insert 1101 that is internally received and bonded into an arrow shaft 1103), except that cavity 1102 of broadhead 1104 is at least partially filled with a high density core, or core weight, 1106. High density core 1106 may be held in cavity 1102 by stem insert 1101. High density core 1106 may be constructed of materials such as lead, bismuth, tungsten, or a combination thereof in solid, powder, or pellet form. High density core 1106 may advantageously facilitate selective increase of weight of broadhead 1104 for performance tuning-purposes. Core 1106 may also be used in connection with other arrow systems contemplated herein, including arrow system 900.

Figure 41:
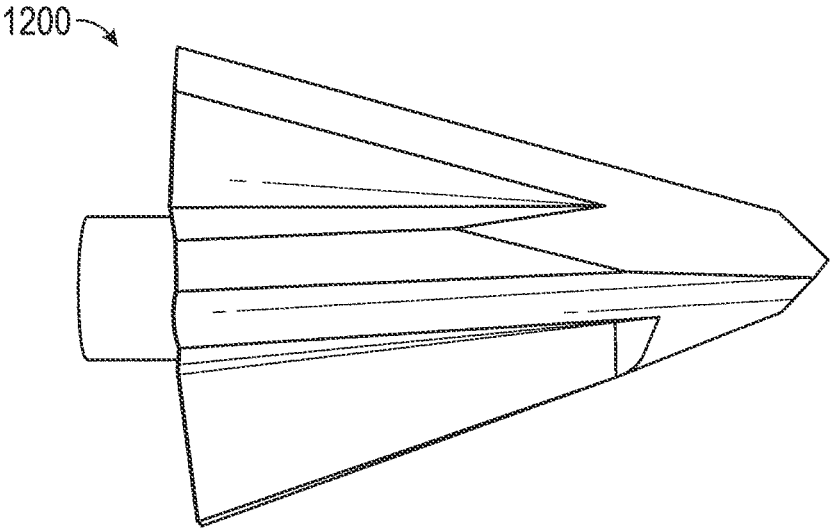
FIG. 41 is a right-side view of another broadhead according to yet another embodiment of the present disclosure.
Figure 42:
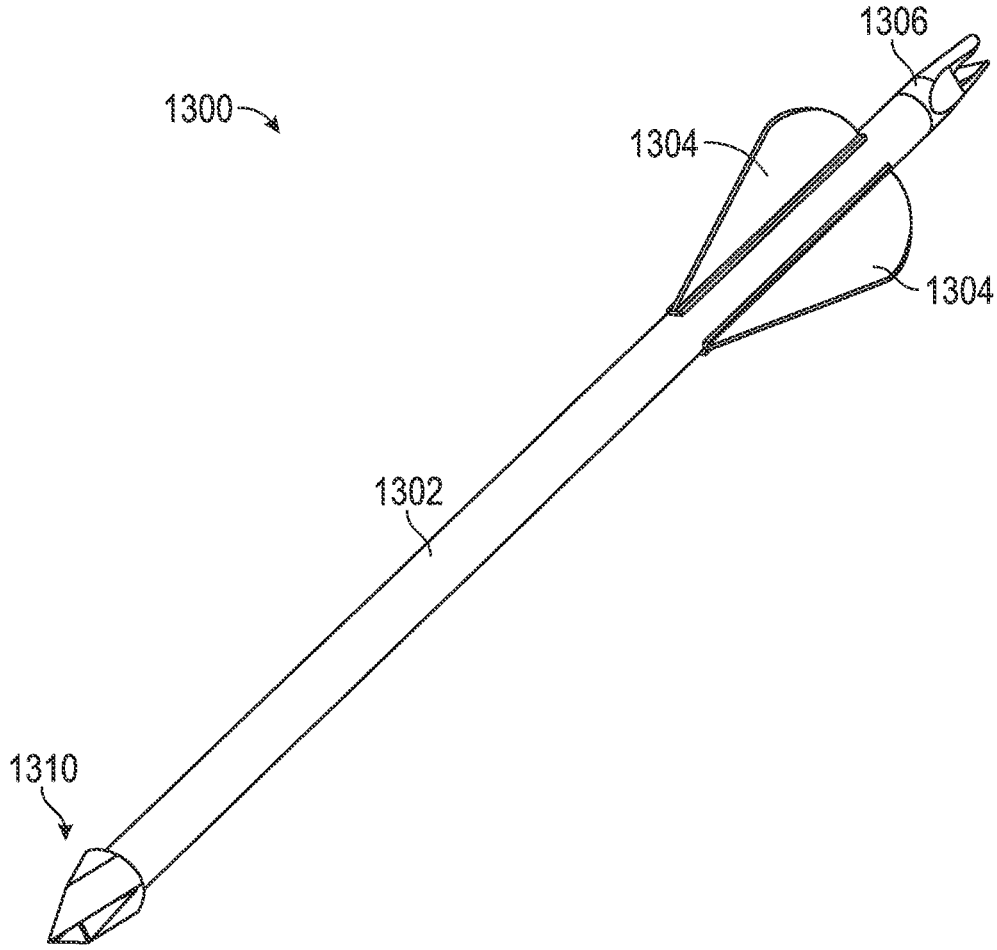
FIG. 42 is a perspective view of an arrow system including a nosetip, a separate glue in stem, arrow shaft, fletching, and a string nock according to another embodiment of the present disclosure.

FIG. 41 illustrates a broadhead 1200 according to an embodiment of the present disclosure. Broadhead 1200 may be constructed from steel. Broadhead 1200 may otherwise be the same or similar to broadhead 610.

Field points and separable nosetip portions of mechanical broadheads according to the present disclose can also incorporate multiple, flat facets that automatically maintain a proper bevel angle during sharpening. Such field points and mechanical broadheads may advantageously match the aerodynamic flight performance of a two-blade broadhead employing the same features, and may also enhance penetration performance of the field points when pursuing small game or penetration performance through bone for nosetips of a mechanical broadheads.

For example, FIGS. 42-51D show an arrow system 1300, or components thereof, according to an embodiment of the present disclosure. Arrow system 1300 includes an arrow shaft 1302, a fletching 1304, a string nock 1306, and an insert 1308 (FIG. 43) which threadably receives a nosetip 1310. Arrow shaft 1302, fletching 1304, string nock 1306, and insert 1308 may take any conventional form known to those of ordinary skill in the art.

Figure 43:
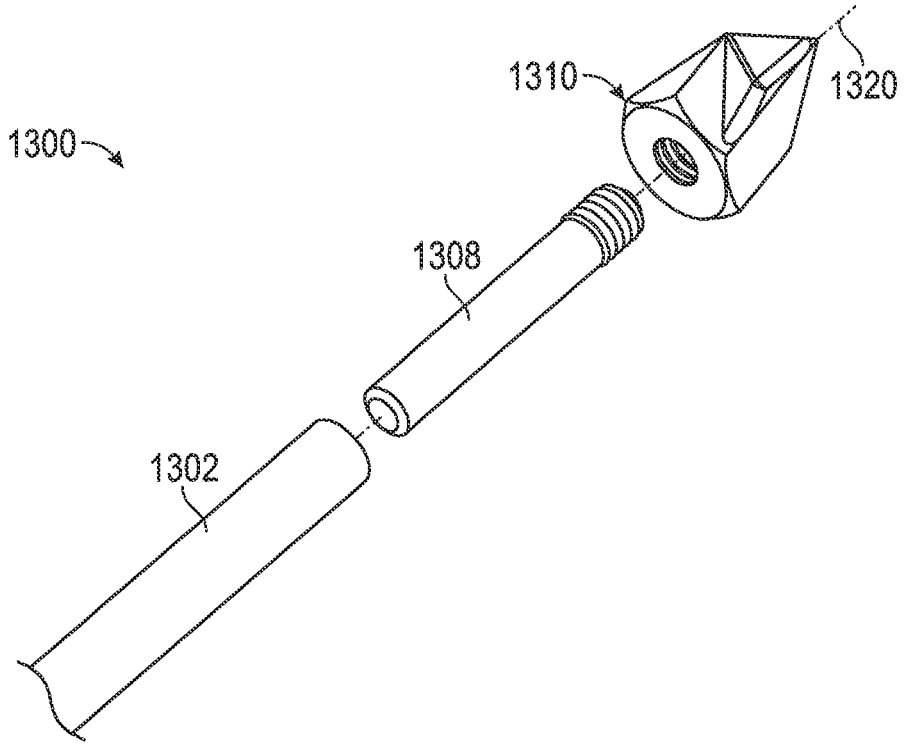
FIG. 43 is an exploded rear perspective view of the arrow system of FIG. 42.
Figure 44:
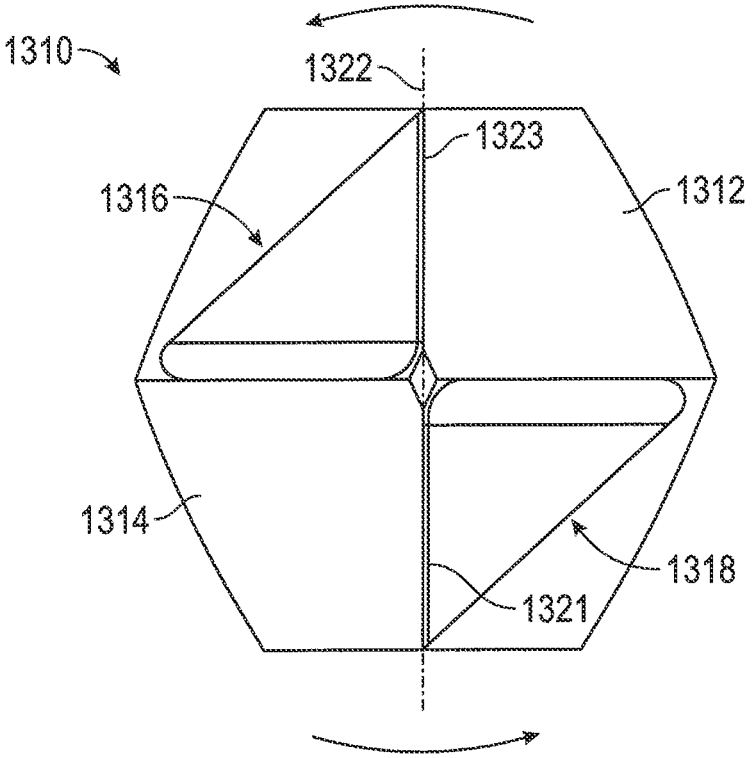
FIG. 44 is a front view of the nosetip of FIG. 42.
Figure 45:
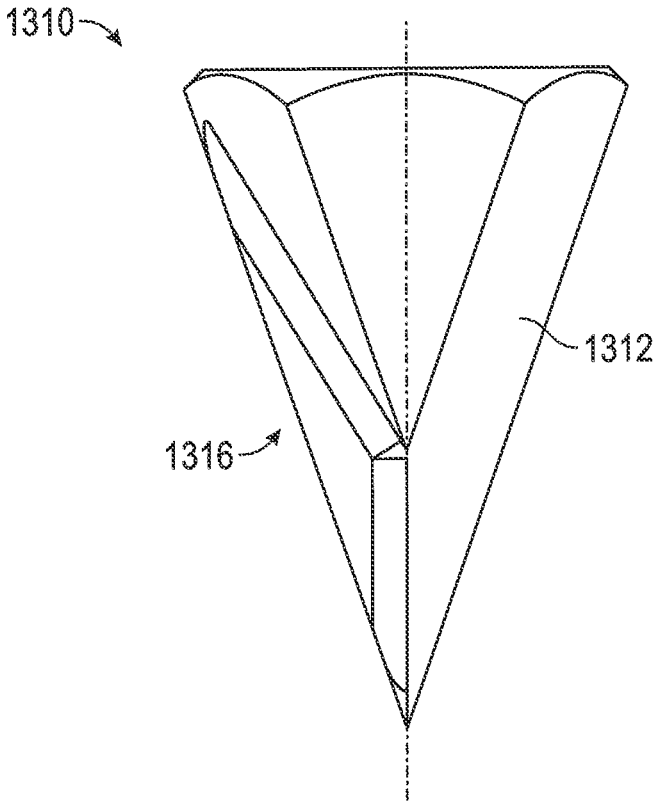
FIG. 45 is a top view of the nosetip of FIG. 42.
Figure 46:
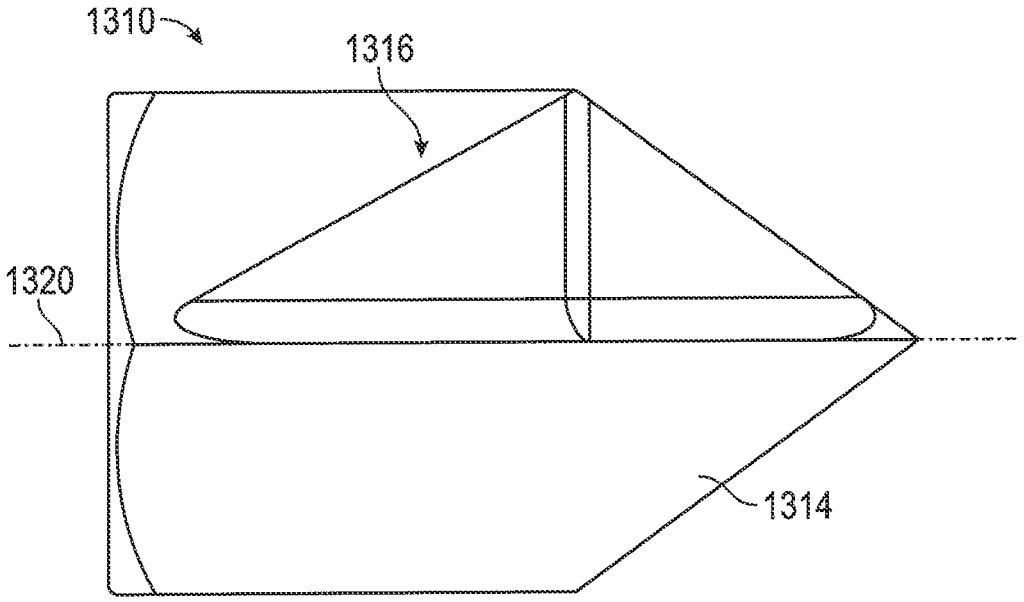
FIG. 46 is a right side view of the nosetip of FIG. 42.
Figure 47:
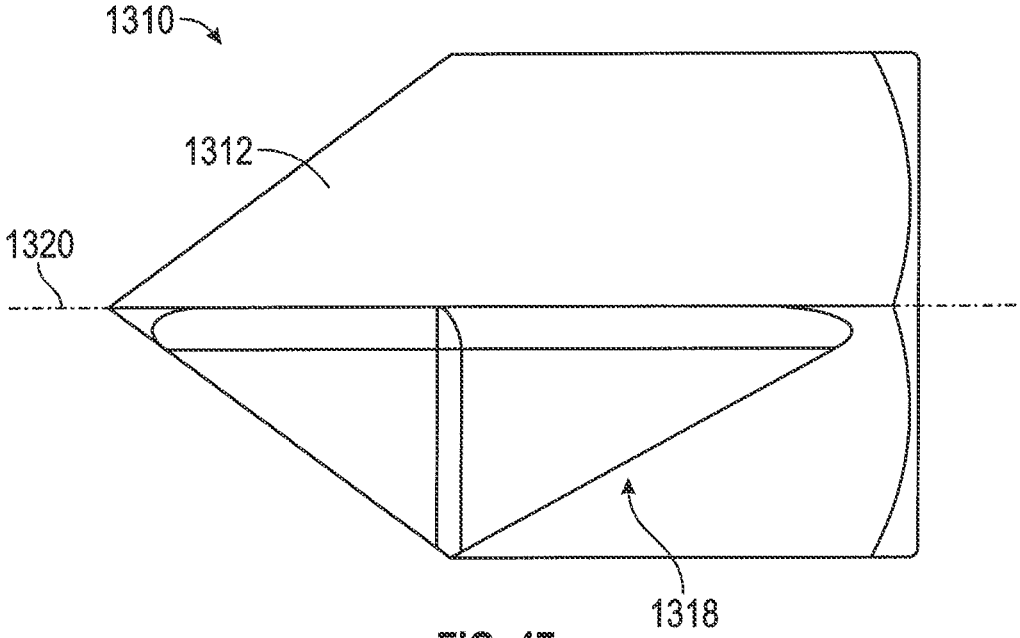
FIG. 47 is a left side view of the nosetip of FIG. 42.
Figure 48:
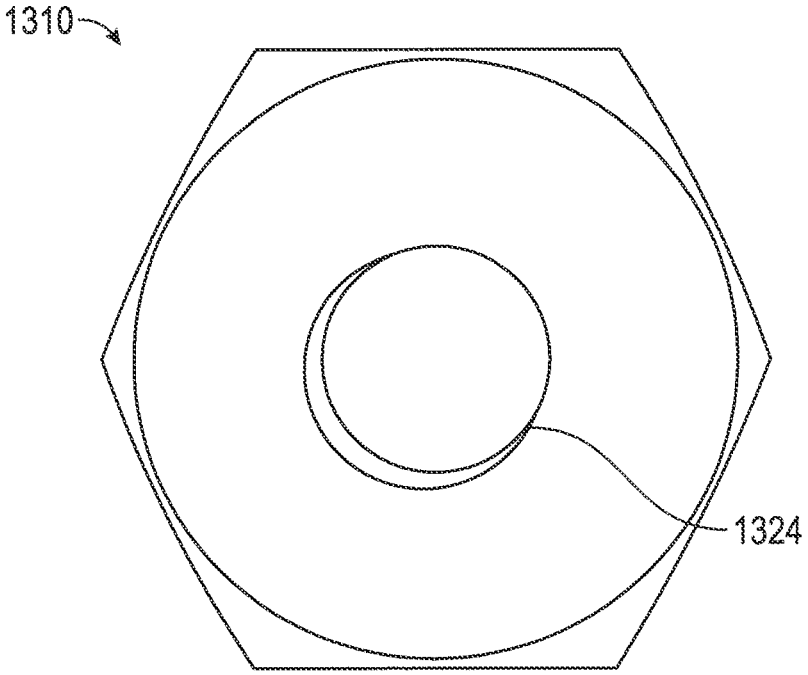
FIG. 48 is a rear view of the nosetip of FIG. 42.

FIG. 44 shows a front view of nosetip 1310. Nosetip 1310 includes 180 degree axially rotational (i.e., diagonal) symmetry. A large primary facet 1312 is positioned toward the upper right of the view and a large primary facet 1314 is positioned toward the lower left of the view. Primary facets 1312, 1314 present the most surface area as viewed in FIG. 44. Nosetip 1310 also includes a cavity 1316 and a cavity 1318, which are positioned horizontally opposite primary facet 1312 and primary facet 1314, respectively. The relative positioning of primary facets 1312, 1314 and cavities 1316, 1318 facilitate relative counterclockwise rotation around central axis 1320 during penetration as indicated by the arrows in FIG. 44. This rotation is due to the greater force exerted on primary facets 1312, 1314 by the target. Primary facets 1312, 1314 thereby advantageously facilitate splitting and separating bone structure and allows unimpeded penetration of arrow shaft 1302 (FIG. 43). As illustrated, a cutting edge 1321 and a cutting edge 1323 of nosetip 1310 are centrally aligned with the primary vertical axis 1322. FIG. 45 shows a top view of nosetip 1310 and specifically illustrates the relative size of primary facet 1312 and cavity 1316. FIG. 45 also illustrates is an overall wedge-shaped outline of nosetip 1310, which further facilitates splitting and separating bone structure. FIGS. 46 and 47 show side views of nosetip 1310 and further illustrate the rotationally symmetric layout of facets 1312, 1314 and cavities 1316, 1318 about central axis 1320 of nosetip 1310. FIG. 48 shows a rear view of nosetip 1310, specifically illustrating a centrally located blind threaded hole 1324 which threadably receives a separate insert 1308 (FIG. 43).

Figure 49A:
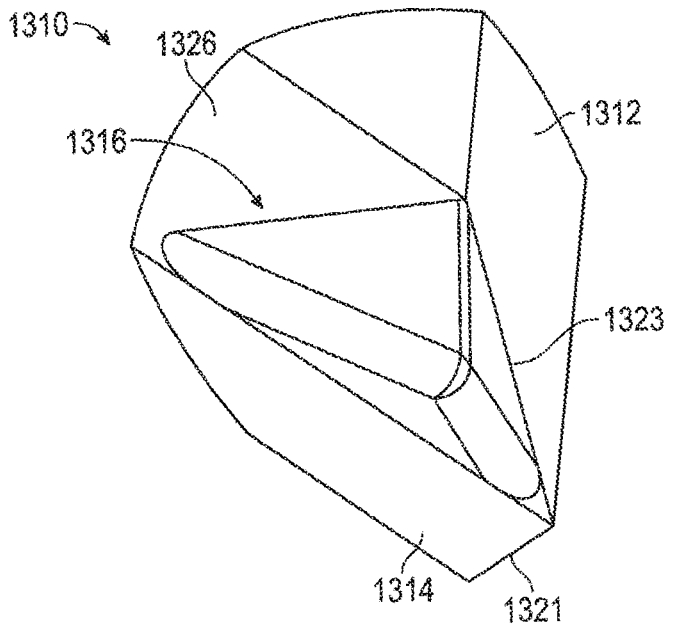
FIG. 49A is a right side perspective view of the nosetip of FIG. 42.
Figure 49B:
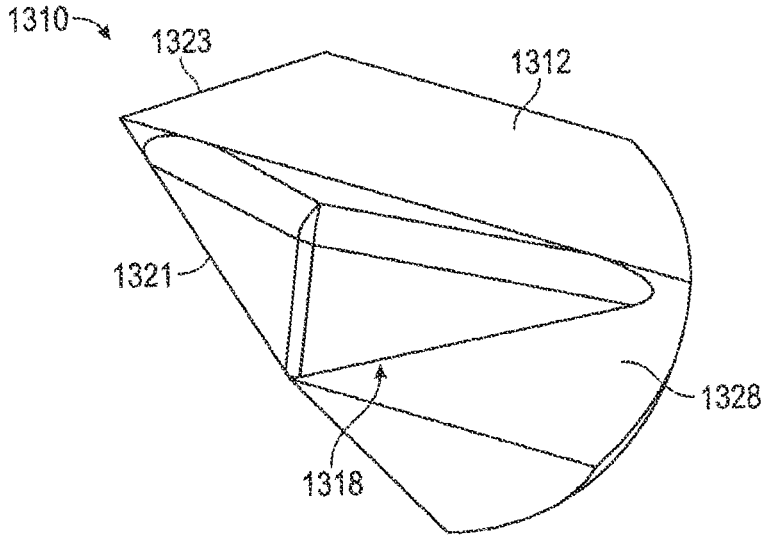
FIG. 49B is a left side perspective view of the nosetip of FIG. 42.

As described briefly above, the facets of nosetip 1310 may be used as guides when sharpening the cutting edges of nosetip 1310. FIGS. 49A and 49B illustrate cutting edge 1323 that is sharpened when primary facet 1312 and an auxiliary facet 1326 are alternatively laid flat against a flat sharpening stone and stroked. Cutting edge 1321 is similarly sharpened when primary facet 1314 and an auxiliary facet 1328 are alternatively laid flat upon a flat sharpening stone and stroked.

Figure 50:
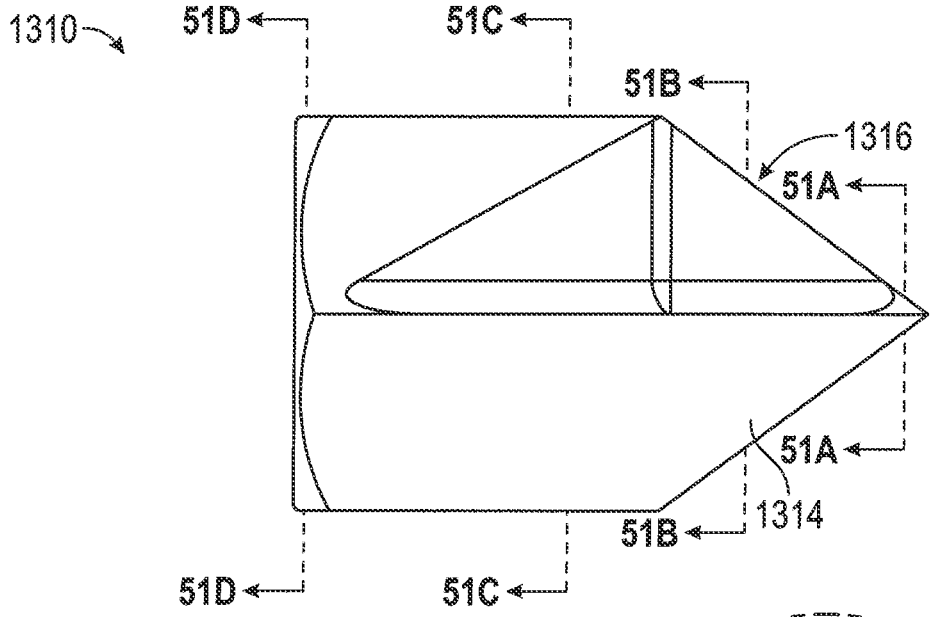
FIG. 50 is a right side view of the nosetip of FIG. 42.
Figure 52:
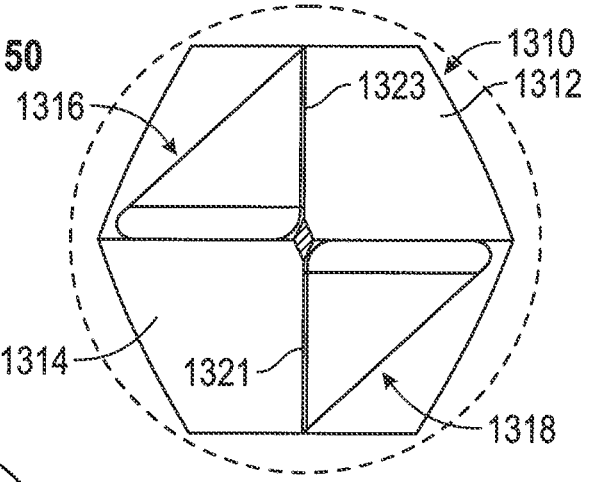
FIG. 52 is another front view of the nosetip of FIG. 42.
Figure 51A:
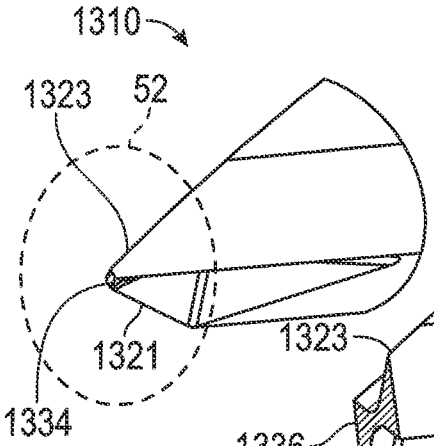
FIG. 51A is a front perspective section view of the nosetip taken along line 51A-51A of FIG. 50.
Figure 51B:
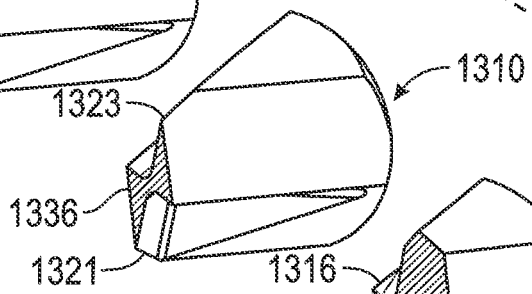
FIG. 51B is a front perspective section view of the nosetip taken along line 51B-51B of FIG. 50.
Figure 51C:
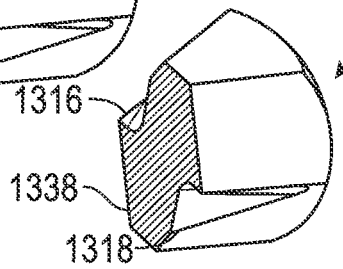
FIG. 51C is a front perspective section view of the nosetip taken along line 51C-51C of FIG. 50.
Figure 51D:
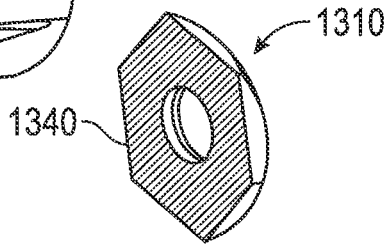
FIG. 51D is a front perspective section view of the nosetip taken along line 51D-51D of FIG. 50.

FIGS. 50-52 show cross-sectional shapes of nosetip 1310, more specifically cavity 1316, cavity 1318, primary facet 1314, and primary facet 1312 (FIG. 52) of nosetip 1310. FIGS. 51A and 52 show that a leading portion 1334 of nosetip 1310 includes a symmetric diamond cross-sectional shape. This shape provides structural rigidity such that leading portion 1334 of nosetip 1310 does not deform during the onset of penetrating bone or when striking other hard objects such as rocks. FIGS. 51B and 51C shows that a first intermediate portion 1336 of nosetip 1310 and a second intermediate portion 1338 of nosetip 1310, respectively, include cross-sections having diagonally symmetric single bevel cutting edges 1323 and 1321 (FIG. 51B) and symmetric cavities 1316 and 1318 (FIG. 51C). FIG. 51D shows that a trailing portion 1340 of nosetip 1310 includes a hexagonal cross-sectional shape.

Figure 53:
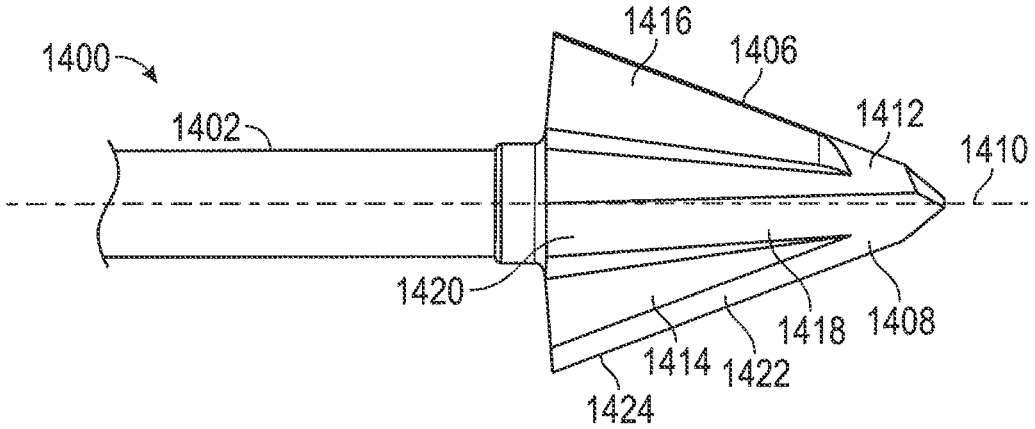
FIG. 53 is a side view of an arrow system including a broadhead, an insert, and an arrow shaft according to another embodiment of the present disclosure.
Figure 54:
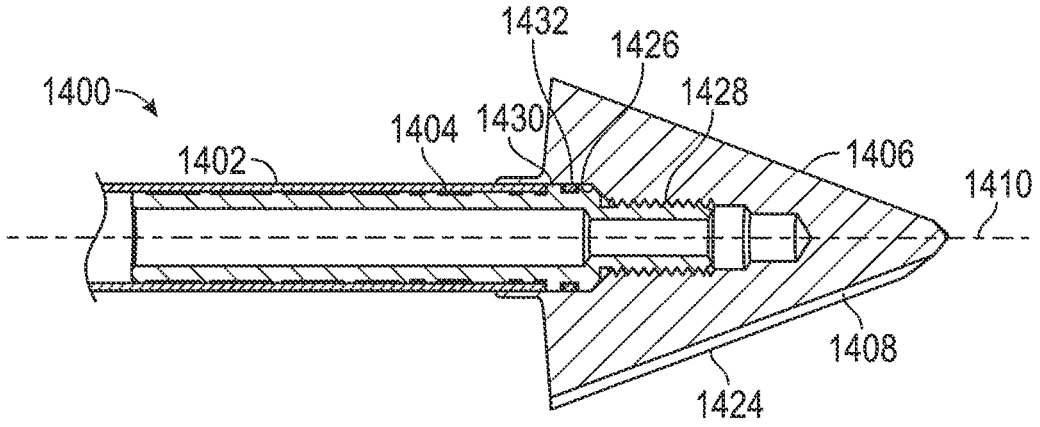
FIG. 54 is a partial section side view of the arrow system of FIG. 53.

FIGS. 53 and 54 show an arrow system 1400 according to an embodiment of the present disclosure. Arrow system 1400 generally includes an arrow shaft 1402 and an insert 1404 (FIG. 54) which threadably receives a broadhead 1406 that includes face-facet sharpening features. Arrow system 1400 also includes a fletching and a string nock (neither shown). Arrow shaft 1402, the fletching, the string nock, and insert 1404 may take any conventional form known to those of ordinary skill in the art.

Broadhead 1406 may be generally similar to any of the broadheads described herein, such as broadhead 610. More specifically, broadhead 1406 includes 180-degree axially rotational (i.e., diagonal) symmetry such that a first primary facet 1408, if rotated through 180 degrees around central axis 1410 would overlap a second primary facet on the opposite side of broadhead 1406 (not shown), a first auxiliary facet 1412 (FIG. 53) would overlap a second auxiliary facet on the opposite side of broadhead 1406 (not shown), and similarly cutouts 1414, 1416 (FIG. 53) would overlap cutouts on the opposite side of broadhead 1406 (neither shown). Facet 1408 includes a first primary facet portion 1418 formed on a ferrule 1420 and a second primary facet portion 1422 formed on a first blade 1424, and first primary facet portion 1418 and second primary facet portion 1422 together define a first planar surface. In contrast to broadhead 610, first primary facet portion 1418 has a length that is a relatively high percentage of an overall length of broadhead 1406. For example, the first facet portion length may be as low as 85 percent, 87 percent, or 89 percent of the broadhead length and as high as 96 percent, 98 percent, or 100 percent of the broadhead length, or may be encompassed by a range including any two of the foregoing percentages as endpoints. The second primary facet on the opposite side of broadhead 1406 may include similar features.

Referring specifically to FIG. 54, insert 1404 may be glued into arrow shaft 1402, and broadhead 1406 receives insert 1404 in an internal cavity 1426. More specifically, broadhead 1406 is threadably attached to a threaded stem 1428 of insert 1404 within cavity 1426. Insert 1404 further includes a bulkhead 1430 that carries a sealing member 1432, such as an o-ring, and sealing member 1432 contacts broadhead 1406 within cavity 1426.

FIGS. 55-60 show an arrow system 1500, or components thereof, according to an embodiment of the present disclosure. Arrow system 1500 generally includes an arrow shaft 1502 and an insert 1504 (FIG. 55) which threadably receives a collet 1505, which in turn threadably receives a broadhead 1506 that includes face-facet sharpening features. Arrow system 1500 also includes a fletching and a string nock (neither shown). Arrow shaft 1502, the fletching, the string nock, and insert 1504 may take any conventional form known to those of ordinary skill in the art.

Broadhead 1506 may be generally similar to any of the broadheads described herein, and more specifically, may be externally identical to broadhead 1406 as shown in FIG. 53. Repeat description is therefore omitted.

Figure 55:
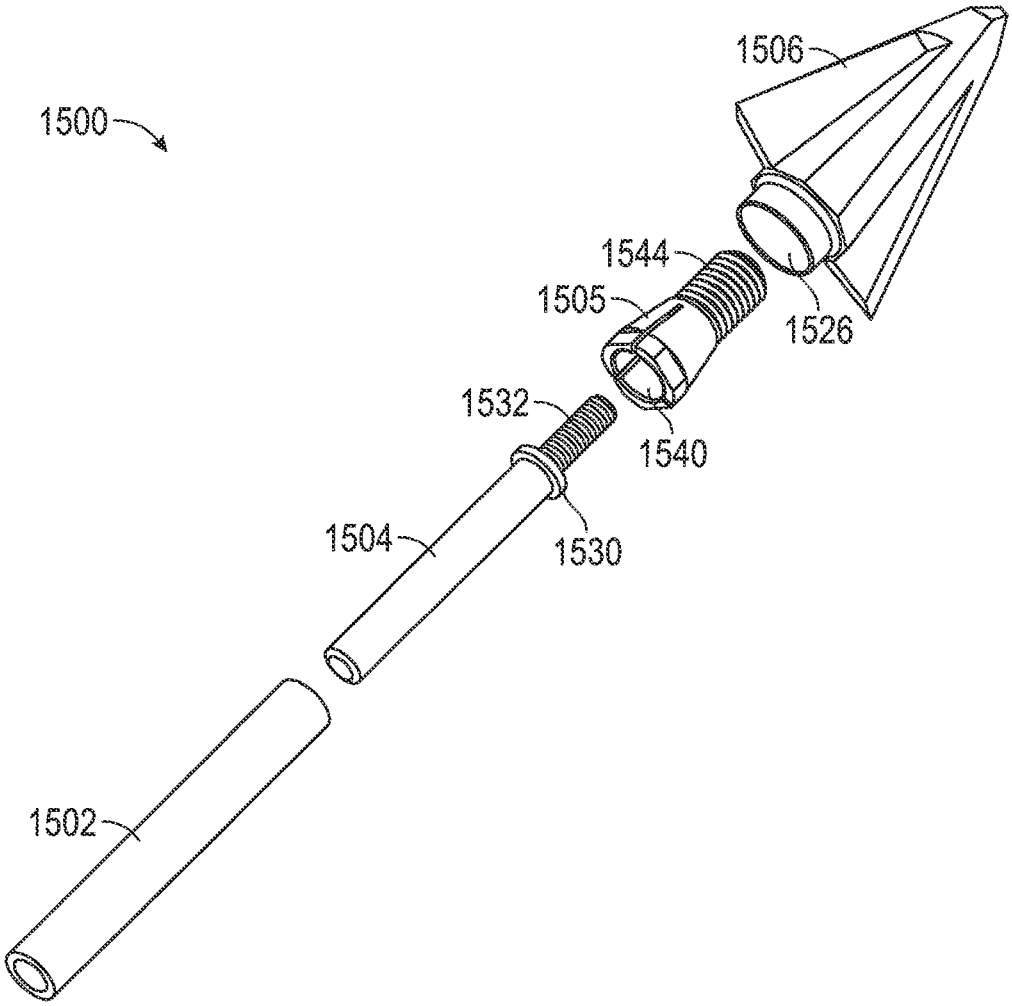
FIG. 55 is an exploded rear perspective view of an arrow system including a broadhead, a collet, an insert, and an arrow shaft according to another embodiment of the present disclosure.

Referring specifically to FIG. 55, insert 1504 may be glued into arrow shaft 1502, and insert 1504 is threadably received by collet 1505. Broadhead 1506 threadably receives collet 1505 in an internal cavity 1526. More specifically, broadhead 1506 is threadably attached to a threaded stem 1544 of collet 1505 within cavity 1526. Collet 1505 is threadably attached to a threaded stem 1532 of insert 1504 within a cylindrical cavity 1540. Insert 1504 further includes a bulkhead 1530 that contacts arrow shaft 1502 and collet 1505 within cavity 1540.

Figure 56:
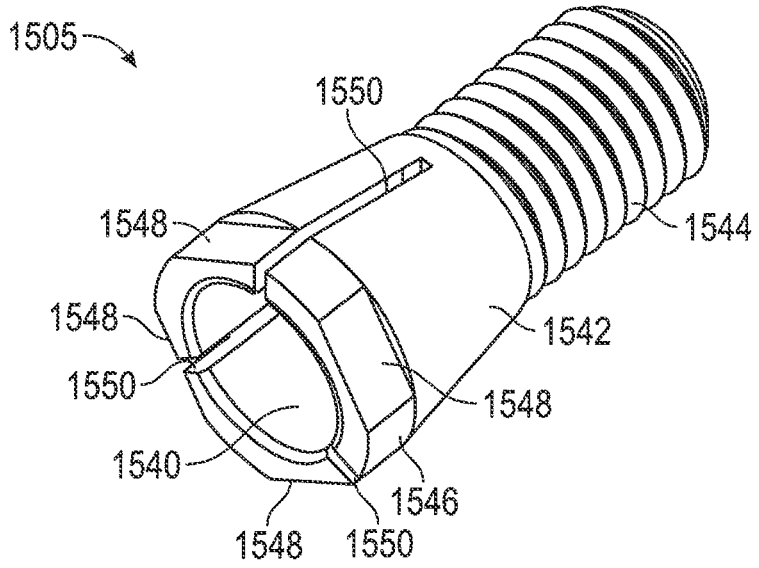
FIG. 56 is a rear perspective view of the collet of FIG. 55.
Figure 57:
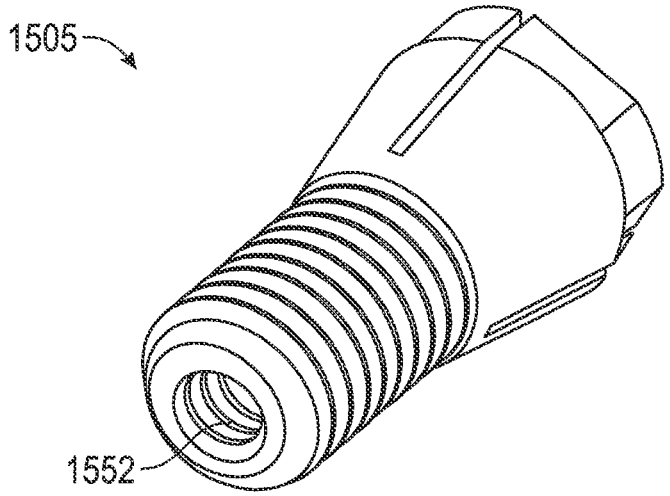
FIG. 57 is a front perspective view of the collet of FIG. 55.

FIGS. 56 and 57 further illustrated collet 1505. Referring specifically to FIG. 56, collet 1505 includes a tapered section 1542 and a threaded stem 1544. Collet 1505 also includes a cylindrical extension 1546 containing multiple flats 1548. Tapered section 1542 and cylindrical extension 1546 also include multiple radial slits 1550. Cylindrical cavity 1540 of collet 1505 receives arrow shaft 1502 (shown elsewhere) together with glued-in insert 1504 (shown elsewhere). Referring specifically to FIG. 57, threaded stem 1532 of insert 1504 is additionally received by an internal threaded portion 1552 of collet 1505.

Figure 58:
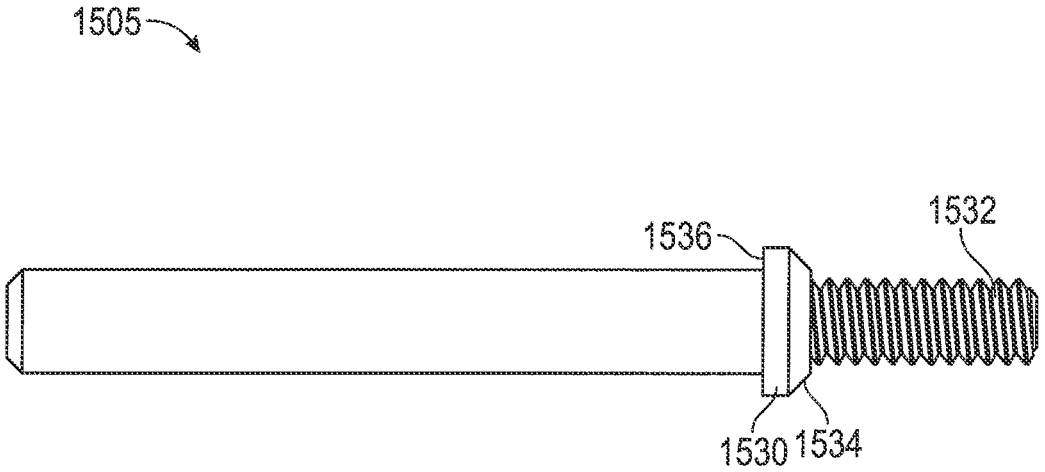
FIG. 58 is a side view of the insert of FIG. 55.

FIG. 58 further illustrates insert 1504. Bulkhead 1530 includes a tapered surface 1534 and flat surface 1536. Upon assembly of insert 1504 within arrow shaft 1502 (shown elsewhere), flat surface 1536 serves as an end stop for the shaft 1502 which precisely positions the shaft 1502 lengthwise relative to collet 1505. Similarly, tapered surface 1534 of bulkhead 1530 is received by a matching tapered surface within cavity 1540 of collet 1505 (shown elsewhere), which serves to precisely center arrow shaft 1502 relative to collet 1505 as insert 1504 is drawn into collet 1505 via threaded stem 1532.

Figure 59:
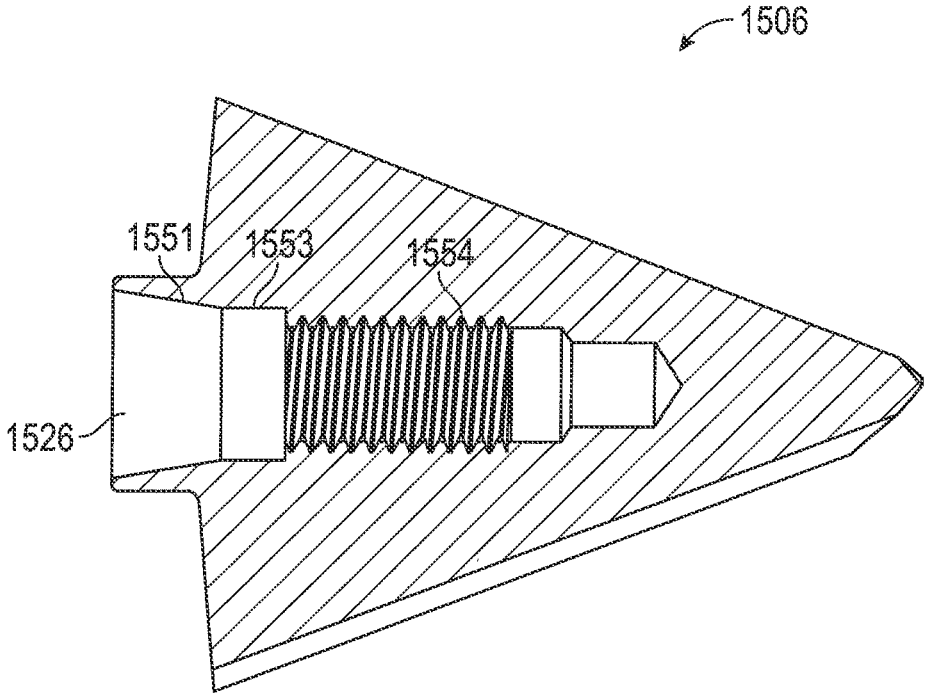
FIG. 59 is a section side view of the broadhead of FIG. 55.
Figure 60:
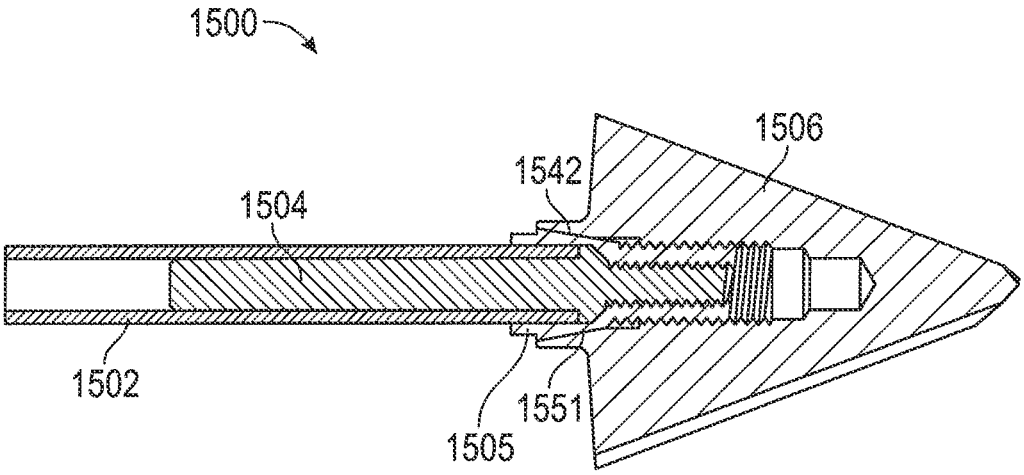
FIG. 60 is a partial section side view of the assembled arrow system of FIG. 55.

FIG. 59 is a cross-section view of broadhead 1506 illustrating further details of cavity 1526. Tapered section 1551 of cavity 1526 mates with tapered section 1542 of collet 1505 (shown elsewhere). A threaded section 1554 interfaces with threaded stem 1544 of collet 1505. A cylindrical section 1553 serves as a transition between threaded section 1554 and tapered section 1551 and does not interface with collet 1505 within this region.

Arrow system 1500 may be assembled as follows. Specifically referring to FIG. 60, which is a cross-section view of arrow system 1500 in an assembled state, insert 1504 is first glued into arrow shaft 1502. Insert 1504 is then threadably attached to collet 1505 outside of broadhead 1506. In the final step collet 1505 is threadably received by broadhead 1506. The action of threading together collet 1505 and broadhead 1506 is enabled via an open end wrench (not shown) engaging with flats 1548 (shown elsewhere) of collet 1505. As collet 1505 is drawn into broadhead 1506, tapered section 1542 of collet 1505 interfaces with tapered section 1551 of broadhead 1506, which due to relief provided by slits 1550 (shown elsewhere) force collet 1505 to close upon arrow shaft 1502.

Broadheads and nosetips according to embodiments of the present disclosure may be manufactured from high-strength steel using common machine shop practices of lathe and mill work, metal injection molding, metal 3D printing or other forming techniques. Separate glue-in or threaded inserts may be manufactured from steel, aluminum, titanium, or other metal alloys using common machining practices of lathe and mill work. Core weights may be made of lead, bismuth, tungsten alloy, or other heavy metal with a density greater than steel and may be swaged using dies, machined via common machining techniques such as lathe work, or 3D printed. Core weights may also be of powder or pellet form.

ASPECTS OF THE DISCLOSURE

According to some embodiments of the present disclosure, a fixed blade, two-blade broadhead employs multiple, flat surface facets that automatically hold the correct bevel angle for edge sharpening when the broadhead is placed upon a sharpening stone. The cutting edges of the broadhead are sharpened without the need of additional sharpening guides.

According to some embodiments of the present disclosure, each section of a broadhead performs a specific task-more specifically, the first approximately ⅓ of the length of the broadhead is designed to maximize the cross-sectional area of the broadhead such that it can withstand impact with bone and rocky soil without deforming. The remaining ⅔ of the length of the broadhead is designed to cut through tissue and to sever arteries and lung tissue as cleanly and efficiently as possible. Near the forward tip of the broadhead for approximately ⅓ of the length of the broadhead, the cross section is an asymmetric, rotated diamond shape. The rotated diamond shape adds increased strength to the front of the broadhead due to an increased thickness of the blade edges. Furthermore, the rotated diamond double-bevel shape causes the broadhead to initiate rotation through the target.

According to some embodiments of the present disclosure, a broadhead as viewed from the top incorporates a smoothly transitioning, high mechanical advantage wedge-shaped body which further aids in splitting and separating bone structure, functioning in a way similar to how an axe or a maul splits wood.

According to some embodiments of the present disclosure, a broadhead threadably attaches to the distal end of separate glue-in stem insert, the insert also being internally received and bonded into an arrow shaft. The arrow shaft is also tightly received via a friction fit into a bored-out cavity of the broadhead.

According to some embodiments of the present disclosure, an arrow system includes a universal threaded adapter to threadably connect a broadhead to an arrow shaft via an insert or an outsert.

According to some embodiments of the present disclosure, a broadhead includes a central cavity that may receive a core weight.

The concept of employing multiple, flat surface facets that automatically hold the correct bevel angle when a broadhead is placed upon a sharpening stone can also be applied to field points and separable nosetips of mechanical broadheads.

According to a first exemplary embodiment of the present disclosure, a broadhead comprises a ferrule; a first blade coupled to the ferrule, the first blade comprising a first cutting edge; a second blade coupled to the ferrule opposite the first blade, the second blade comprising a second cutting edge; and a facet partially bound by the first cutting edge, the facet comprising a first facet portion formed on the ferrule and a second facet portion formed on the first blade, the first facet portion and the second facet portion together defining a planar surface; wherein the planar surface is configured to contact a support surface while sharpening the first cutting edge.

According to a second exemplary embodiment of the present disclosure, the broadhead of the first exemplary embodiment, further comprising a cutout disposed between the first blade and the ferrule, the cutout partially separating the first facet portion from the second facet portion.

According to a third exemplary embodiment of the present disclosure, the broadhead of the second exemplary embodiment, further comprising a tip portion and the first blade further comprising an aft end portion, the broadhead having a broadhead length between the tip portion and the aft end portion, and the cutout having a cutout length being inclusively between 50 percent and 85 percent of the broadhead length.

According to a fourth exemplary embodiment of the present disclosure, the broadhead of the first exemplary embodiment, further comprising a tip portion and the first blade further comprising an aft end portion, the broadhead having a broadhead length between the tip portion and the aft end portion, and the first facet portion having a first facet portion length being inclusively between 45 percent and 100 percent of the broadhead length.

According to a fifth exemplary embodiment of the present disclosure, the broadhead of the first exemplary embodiment, further comprising a tip portion and the first blade further comprising an aft end portion, the broadhead having a broadhead length between the tip portion and the aft end portion, and the second facet portion having a second facet portion length being inclusively between 85 percent and 100 percent of the broadhead length.

According to a sixth exemplary embodiment of the present disclosure, the broadhead of the first exemplary embodiment, wherein the facet is a primary facet formed on a first side of the first blade, the first facet portion is a first primary facet portion, the second facet portion is a second primary facet portion, the planar surface is a first planar surface, and further comprising an auxiliary facet formed on a second side of the first blade, the auxiliary facet being partially bound by the first cutting edge, the auxiliary facet comprising a first auxiliary facet portion formed on the ferrule and a second auxiliary facet portion formed on the first blade, the first auxiliary facet portion and the second auxiliary facet portion together defining a second planar surface configured to contact a support surface while sharpening the first cutting edge.

According to a seventh exemplary embodiment of the present disclosure, the broadhead of the first exemplary embodiment, wherein the facet is a first facet and the planar surface is a first planar surface, and further comprising a second facet partially bound by the second cutting edge, the second facet comprising a third facet portion formed on the ferrule and a fourth facet portion formed on the second blade, the third facet portion and the fourth facet portion together defining a second planar surface configured to contact a support surface while sharpening the second cutting edge.

According to an eighth exemplary embodiment of the present disclosure, the broadhead of the first exemplary embodiment, further comprising a leading double-bevel portion.

According to a ninth exemplary embodiment of the present disclosure, the broadhead of the eighth exemplary embodiment, further comprising a trailing single-bevel portion.

According to tenth exemplary embodiment of the present disclosure, the broadhead of the eighth exemplary embodiment, wherein the broadhead has a longitudinal axis and a first midplane bisecting the first blade and the second blade and in which the longitudinal axis lies, the first midplane being rotationally offset from the first cutting edge and the second cutting edge, wherein leading double-bevel portion comprises a cross-sectional area having a first vertex, a second vertex opposite the first vertex, a third vertex, and a fourth vertex opposite the third vertex, the broadhead having a second midplane in which the longitudinal axis lies, the second midplane bisecting the cross-sectional area and intersecting with the first vertex and the second vertex, the second midplane being rotationally offset from the first midplane.

According to an eleventh exemplary embodiment of the present disclosure, the broadhead of the tenth exemplary embodiment, wherein the first cutting edge defines the first vertex of the cross-sectional area and the second cutting edge defines the second vertex of the cross-sectional area.

According to a twelfth exemplary embodiment of the present disclosure, the broadhead of the eighth exemplary embodiment, wherein the leading double-bevel portion comprises a parallelogram-shaped cross-sectional area.

According to a thirteenth exemplary embodiment of the present disclosure, the broadhead of the twelfth exemplary embodiment, wherein the broadhead has a longitudinal axis and a first midplane bisecting the first blade and the second blade and in which the longitudinal axis lies, the first midplane being rotationally offset from the first cutting edge and the second cutting edge, wherein the parallelogram-shaped cross-sectional area has a first vertex, a second vertex opposite the first vertex, a third vertex, and a fourth vertex opposite the third vertex, the broadhead having a second midplane in which the longitudinal axis lies, the second midplane bisecting the parallelogram-shaped cross-sectional area and intersecting with the first vertex and the second vertex, the second midplane being rotationally offset from the first midplane.

According to a fourteenth exemplary embodiment of the present disclosure, the broadhead of the thirteenth exemplary embodiment, wherein the first cutting edge defines the first vertex of the parallelogram-shaped cross-sectional area and the second cutting edge defines the second vertex of the parallelogram-shaped cross-sectional area.

According to a fifteenth exemplary embodiment of the present disclosure, the broadhead of the first exemplary embodiment, wherein the broadhead comprises a body that monolithically forms the ferrule, the first blade, and the second blade.

According to a sixteenth exemplary embodiment of the present disclosure, a broadhead comprises a longitudinal axis; a trailing single-bevel portion comprising a first blade and a second blade, the first blade comprising a first cutting edge and the second blade comprising a second cutting edge; a first midplane in which the longitudinal axis lies, the first midplane bisecting the first blade and the second blade and being rotationally offset from the first cutting edge and the second cutting edge; a leading double-bevel portion comprising a cross-sectional area, the cross-sectional area having a first vertex, a second vertex opposite the first vertex, a third vertex, and a fourth vertex opposite the third vertex; and a second midplane in which the longitudinal axis lies, the second midplane bisecting the cross-sectional area and intersecting with the first vertex and the second vertex, the second midplane being rotationally offset from the first midplane.

According to a seventeenth exemplary embodiment of the present disclosure, the broadhead of the sixteenth exemplary embodiment, wherein the first cutting edge defines the first vertex of the cross-sectional area and the second cutting edge defines the second cutting edge of the cross-sectional area.

According to an eighteenth exemplary embodiment of the present disclosure, the broadhead of the sixteenth exemplary embodiment, wherein the second midplane is rotationally offset from the first midplane in a range inclusively between 3 degrees and 13 degrees.

According to a nineteenth exemplary embodiment of the present disclosure, the broadhead of the sixteenth exemplary embodiment, wherein the second midplane is rotationally offset from the first midplane in a range inclusively between 5 degrees and 11 degrees.

According to a twentieth exemplary embodiment of the present disclosure, the broadhead of the sixteenth exemplary embodiment, wherein the cross-sectional area is parallelogram-shaped.

According to a twenty first exemplary embodiment of the present disclosure, the broadhead of the sixteenth exemplary embodiment, wherein the broadhead comprises a body that monolithically forms the trailing single-bevel portion and the leading double-bevel portion.

According to a twenty second exemplary embodiment of the present disclosure, an arrow system comprises a broadhead comprising a ferrule, a first blade coupled to the ferrule, and a second blade coupled to the ferrule opposite the first blade, the ferrule comprising a first attachment bore having an internal threaded surface; an insert configured to be received in the first attachment bore of the broadhead, the insert comprising an external threaded surface configured to threadably coupled to the internal threaded surface; and an arrow shaft comprising a second attachment bore into which the insert is receivable, and the arrow shaft being receivable within the first attachment bore between the ferrule and the insert.

According to a twenty third exemplary embodiment of the present disclosure, the arrow system of the twenty second exemplary embodiment, further comprising a core weight configured to be received in the first attachment bore.

According to a twenty fourth exemplary embodiment of the present disclosure, the arrow system of the twenty second exemplary embodiment, wherein the insert is configured to be slidably received in the first attachment bore and adhered to the broadhead.

According to a twenty fifth exemplary embodiment of the present disclosure, an arrow system comprises a broadhead comprising a ferrule, a first blade coupled to the ferrule, and a second blade coupled to the ferrule opposite the first blade, the ferrule comprising a first attachment bore having an internal threaded surface; an adapter configured to be received in the first attachment bore of the broadhead, the adapter comprising a first external threaded surface configured to threadably coupled to the internal threaded surface, and the adapter further comprising a second external threaded surface; and an arrow shaft comprising a second attachment bore; wherein the second external threaded surface is configured to couple to both an insert configured to be disposed in the second attachment bore of the arrow shaft and an outsert comprising a third attachment bore configured to receive the arrow shaft.

According to a twenty sixth exemplary embodiment of the present disclosure, the arrow system of the twenty fifth exemplary embodiment, further comprising a core weight configured to be received in the first attachment bore.

According to a twenty seventh exemplary embodiment of the present disclosure, the arrow system of the twenty fifth exemplary embodiment, wherein the internal threaded surface of the broadhead is a first internal threaded surface, and further comprising the insert, the insert comprising a second internal threaded surface configured to threadably couple to the second external threaded surface of the adaptor.

According to a twenty eighth exemplary embodiment of the present disclosure, the arrow system of the twenty fifth exemplary embodiment, wherein the internal threaded surface of the broadhead is a first internal threaded surface, and further comprising the outsert, the outsert comprising a second internal threaded surface configured to threadably couple to the second external threaded surface of the adaptor.

According to a twenty ninth exemplary embodiment of the present disclosure, the arrow system of the twenty eighth exemplary embodiment, wherein the adaptor is configured to be disposed completely externally of the arrow shaft.

According to a thirtieth exemplary embodiment of the present disclosure, a nosetip comprises a primary facet defining a first plane in which a first cutting edge lies; an auxiliary facet defining a second plane in which the first cutting edge lies; a cavity disposed between the auxiliary facet and the first cutting edge; wherein the primary facet is configured to contact a support surface while sharpening the first cutting edge.

According to a thirty first exemplary embodiment of the present disclosure, the nosetip of the thirtieth exemplary embodiment, wherein the primary facet is a first primary facet, the auxiliary facet is a first auxiliary facet, the cavity is a first cavity, and the nosetip further comprises a second primary facet defining a third plane in which a second cutting edge lies; a second auxiliary facet defining a fourth plane in which the second cutting edge lies; a second cavity disposed between the second auxiliary facet and the second cutting edge; wherein the second primary facet is configured to contact the support surface while sharpening the second cutting edge.

It should be understood that the foregoing description is only illustrative of the present disclosure. Various alternatives and modifications can be devised by those skilled in the art without departing from the disclosure. Accordingly, the present disclosure is intended to embrace all such alternatives, modifications and variances that fall within the scope of the appended claims.

The invention claimed is:

1. A broadhead comprising:

a ferrule;

a first blade coupled to the ferrule, the first blade comprising a first cutting edge;

a second blade coupled to the ferrule opposite the first blade, the second blade comprising a second cutting edge; and a facet partially bound by the first cutting edge, the facet comprising a first facet portion formed on the ferrule and a second facet portion formed on the first blade, the first facet portion and the second facet portion together defining a planar surface;

wherein the planar surface is configured to contact a support surface while sharpening the first cutting edge.

2. The broadhead of claim 1, further comprising a cutout disposed between the first blade and the ferrule, the cutout partially separating the first facet portion from the second facet portion.

3. The broadhead of claim 2, further comprising a tip portion and the first blade further comprising an aft end portion, the broadhead having a broadhead length between the tip portion and the aft end portion, and the cutout having a cutout length being inclusively between 50 percent and 75 percent of the broadhead length.

4. The broadhead of claim 1, further comprising a tip portion and the first blade further comprising an aft end portion, the broadhead having a broadhead length between the tip portion and the aft end portion, and the first facet portion having a first facet portion length being inclusively between 45 percent and 100 percent of the broadhead length.

5. The broadhead of claim 1, further comprising a tip portion and the first blade further comprising an aft end portion, the broadhead having a broadhead length between the tip portion and the aft end portion, and the second facet portion having a second facet portion length being inclusively between 85 percent and 100 percent of the broadhead length.

6. The broadhead of claim 1, wherein the facet is a primary facet formed on a first side of the first blade, the first facet portion is a first primary facet portion, the second facet portion is a second primary facet portion, the planar surface is a first planar surface, and further comprising an auxiliary facet formed on a second side of the first blade, the auxiliary facet being partially bound by the first cutting edge, the auxiliary facet comprising a first auxiliary facet portion formed on the ferrule and a second auxiliary facet portion formed on the first blade, the first auxiliary facet portion and the second auxiliary facet portion together defining a second planar surface configured to contact a support surface while sharpening the first cutting edge.

7. The broadhead of claim 1, wherein the facet is a first facet and the planar surface is a first planar surface, and further comprising a second facet partially bound by the second cutting edge, the second facet comprising a third facet portion formed on the ferrule and a fourth facet portion formed on the second blade, the third facet portion and the fourth facet portion together defining a second planar surface configured to contact a support surface while sharpening the second cutting edge.

8. The broadhead of claim 1, further comprising a leading double-bevel portion.

9. The broadhead of claim 8, further comprising a trailing single-bevel portion.

10. The broadhead of claim 8, wherein the broadhead has a longitudinal axis and a first midplane bisecting the first blade and the second blade and in which the longitudinal axis lies, the first midplane being rotationally offset from the first cutting edge and the second cutting edge, wherein leading double-bevel portion comprises a cross-sectional area having a first vertex, a second vertex opposite the first vertex, a third vertex, and a fourth vertex opposite the third vertex, the broadhead having a second midplane in which the longitudinal axis lies, the second midplane bisecting the cross-sectional area and intersecting with the first vertex and the second vertex, the second midplane being rotationally offset from the first midplane.

11. The broadhead of claim 10, wherein the first cutting edge defines the first vertex of the cross-sectional area and the second cutting edge defines the second vertex of the cross-sectional area.

12. The broadhead of claim 8, wherein the leading double-bevel portion comprises a parallelogram-shaped cross-sectional area.

13. The broadhead of claim 12, wherein the broadhead has a longitudinal axis and a first midplane bisecting the first blade and the second blade and in which the longitudinal axis lies, the first midplane being rotationally offset from the first cutting edge and the second cutting edge, wherein the parallelogram-shaped cross-sectional area has a first vertex, a second vertex opposite the first vertex, a third vertex, and a fourth vertex opposite the third vertex, the broadhead having a second midplane in which the longitudinal axis lies, the second midplane bisecting the parallelogram-shaped cross-sectional area and intersecting with the first vertex and the second vertex, the second midplane being rotationally offset from the first midplane.

14. The broadhead of claim 13, wherein the first cutting edge defines the first vertex of the parallelogram-shaped cross-sectional area and the second cutting edge defines the second vertex of the parallelogram-shaped cross-sectional area.

15. The broadhead of claim 1, wherein the broadhead comprises a body that monolithically forms the ferrule, the first blade, and the second blade.

16. A broadhead comprising:

a longitudinal axis;

a trailing single-bevel portion comprising a first blade and a second blade, the first blade comprising a first cutting edge and the second blade comprising a second cutting edge;

a first midplane in which the longitudinal axis lies, the first midplane bisecting the first blade and the second blade and being rotationally offset from the first cutting edge and the second cutting edge;

a leading double-bevel portion comprising a cross-sectional area, the cross-sectional area having a first vertex, a second vertex opposite the first vertex, a third vertex, and a fourth vertex opposite the third vertex; and a second midplane in which the longitudinal axis lies, the second midplane bisecting the cross-sectional area and intersecting with the first vertex and the second vertex, the second midplane being rotationally offset from the first midplane.

17. The broadhead of claim 16, wherein the first cutting edge defines the first vertex of the cross-sectional area and the second cutting edge defines the second cutting edge of the cross-sectional area.

18. The broadhead of claim 16, wherein the second midplane is rotationally offset from the first midplane in a range inclusively between 3 degrees and 13 degrees.

19. The broadhead of claim 16, wherein the second midplane is rotationally offset from the first midplane in a range inclusively between 5 degrees and 11 degrees.

20. The broadhead of claim 16, wherein the cross-sectional area is parallelogram-shaped.

21. The broadhead of claim 16, wherein the broadhead comprises a body that monolithically forms the trailing single-bevel portion and the leading double-bevel portion.

* * * * *